US011293430B2

(12) United States Patent
Kirch

(10) Patent No.: US 11,293,430 B2
(45) Date of Patent: Apr. 5, 2022

(54) SMART PUMP CONTROLLER

(71) Applicant: DropWater Solutions, Gainesville, TX (US)

(72) Inventor: Paul Kirch, Gainesville, TX (US)

(73) Assignee: DROPWATER SOLUTIONS, Gainesville, TX (US)

( * ) Notice: Subject to any disclaimer, the term of this patent is extended or adjusted under 35 U.S.C. 154(b) by 0 days.

(21) Appl. No.: 17/155,920

(22) Filed: Jan. 22, 2021

(65) Prior Publication Data

US 2021/0222689 A1 Jul. 22, 2021

Related U.S. Application Data

(60) Provisional application No. 62/964,216, filed on Jan. 22, 2020.

(51) Int. Cl.
*F04B 49/06* (2006.01)

(52) U.S. Cl.
CPC ..... *F04B 49/065* (2013.01); *F04B 2205/09* (2013.01)

(58) Field of Classification Search
None
See application file for complete search history.

(56) References Cited

U.S. PATENT DOCUMENTS 7,083,202 B2 * 8/2006 Eberle ..... F16L 5/14 285/124.4
7,249,628 B2 * 7/2007 Pillion ..... F28D 7/082 165/289
8,082,217 B2 * 12/2011 Crossley ..... F04D 15/0088 706/16
8,776,617 B2 * 7/2014 Durham ..... F04B 51/00 73/862.08
9,057,256 B2 6/2015 Ige et al.
9,297,374 B2 * 3/2016 Braggin ..... F04D 13/06
9,309,872 B2 * 4/2016 Gonnella ..... F04B 25/00
9,617,814 B2 4/2017 Seals et al.
9,719,504 B2 * 8/2017 Vines ..... B01D 19/0073
10,480,547 B2 * 11/2019 Starkey ..... F04B 49/06
10,724,515 B1 7/2020 Cook et al.
2008/0131290 A1 6/2008 Magoon et al.
2017/0089328 A1 * 3/2017 Sato ..... F04B 53/14
2018/0013293 A1 * 1/2018 Block ..... H02J 4/00
2018/0163730 A1 6/2018 Wilds et al.

* cited by examiner

*Primary Examiner* — Patrick Hamo
(74) *Attorney, Agent, or Firm* — Pillsbury Winthrop Shaw Pittman LLP

(57) ABSTRACT

A process includes obtaining a first set of measurements of an electronic pump operating at a parameter, determining a state value based on the first set of measurements, and determining a reference key based on the state value and the parameter. The process also includes obtaining a second measurement using a second sensor, determining a first threshold, and storing the first threshold in association with the reference key. The process further includes obtaining a second set of measurements including a third and fourth measurement acquired by the first and second sensor. The process further includes determining the reference key based on the third measurement using the function, selecting the first threshold by using the reference key when referencing the data structure. The process further includes determining whether the fourth measurement satisfies criteria based on the first threshold and modifying the electronic pump operation.

20 Claims, 7 Drawing Sheets

SMART PUMP CONTROLLER

CROSS-REFERENCE TO RELATED APPLICATIONS

The present application claims the benefit of the following U.S. Provisional Patent Applications: U.S. 62/964,216, titled SMART PUMP CONTROLLER, filed 22 Jan. 2020; U.S. 62/964,213, titled WIRELESS MESH FOR FLUID DISTRIBUTION NETWORK, filed 22 Jan. 2020; U.S. 62/964,220, titled MULTI-BANDWIDTH COMMUNICATION FOR FLUID DISTRIBUTION NETWORK, filed 22 Jan. 2020. The entire content of each aforementioned patent filing is hereby incorporated by reference.

BACKGROUND

1. Field

This disclosure relates generally to electronic pumps and, more particularly, to electronic pump controllers.

2. Background

Pumps are useful for transporting fluids such as water or gas across vast distances. In addition, pumps may include components to alter the properties of the fluid being pumped by heating or cooling a fluid, adding materials to the fluid, filtering the fluid, or the like. Pumps may include one or more controllers to control pump operations electronically and may further include electronic components to perform real-time analysis of the fluid based on measurements provided by a sensor attached to or otherwise in communication with the pump. Increasing the responsiveness of the controller may increase the utility of the pump or increase the efficiency of pumping operations.

SUMMARY

The following is a non-exhaustive listing of some aspects of the present techniques. These and other aspects are described in the following disclosure.

Some aspects include a process that includes obtaining a first set of measurements output by a first sensor of an electronic pump operating at an operational parameter, wherein the electronic pump comprises a recirculation valve that diverts fluid into a recirculation loop comprising a set of heat exchangers. The process also includes determining a state value based on the first set of measurements using a function that comprises a binning method and determining a reference key based on the state value and the operational parameter in a data structure stored in a local memory of the electronic pump. The process also includes obtaining a second measurement using a second sensor positioned separately from the first sensor. The process also includes determining a first threshold based on the second measurement, storing the first threshold in the data structure in association with the reference key, and obtaining a second set of measurements, wherein the second set of measurements includes a third measurement acquired by the first sensor and a fourth measurement acquired by the second sensor. The process also includes determining the reference key based on the third measurement using the function, selecting the first threshold by using the reference key when referencing the data structure, and determining whether the fourth measurement satisfies a set of criteria based on the first threshold. The process also includes modifying an operation of the electronic pump based on the fourth measurement satisfying the set of criteria.

Some aspects include a tangible, non-transitory, machine-readable medium storing instructions that when executed by a data processing apparatus cause the data processing apparatus to perform operations including the above-mentioned process.

Some aspects include a system, including: one or more processors; and memory storing instructions that when executed by the processors cause the processors to effectuate operations of the above-mentioned process.

BRIEF DESCRIPTION OF THE DRAWINGS

The above-mentioned aspects and other aspects of the present techniques will be better understood when the present application is read in view of the following figures in which like numbers indicate similar or identical elements.

Figure 1:
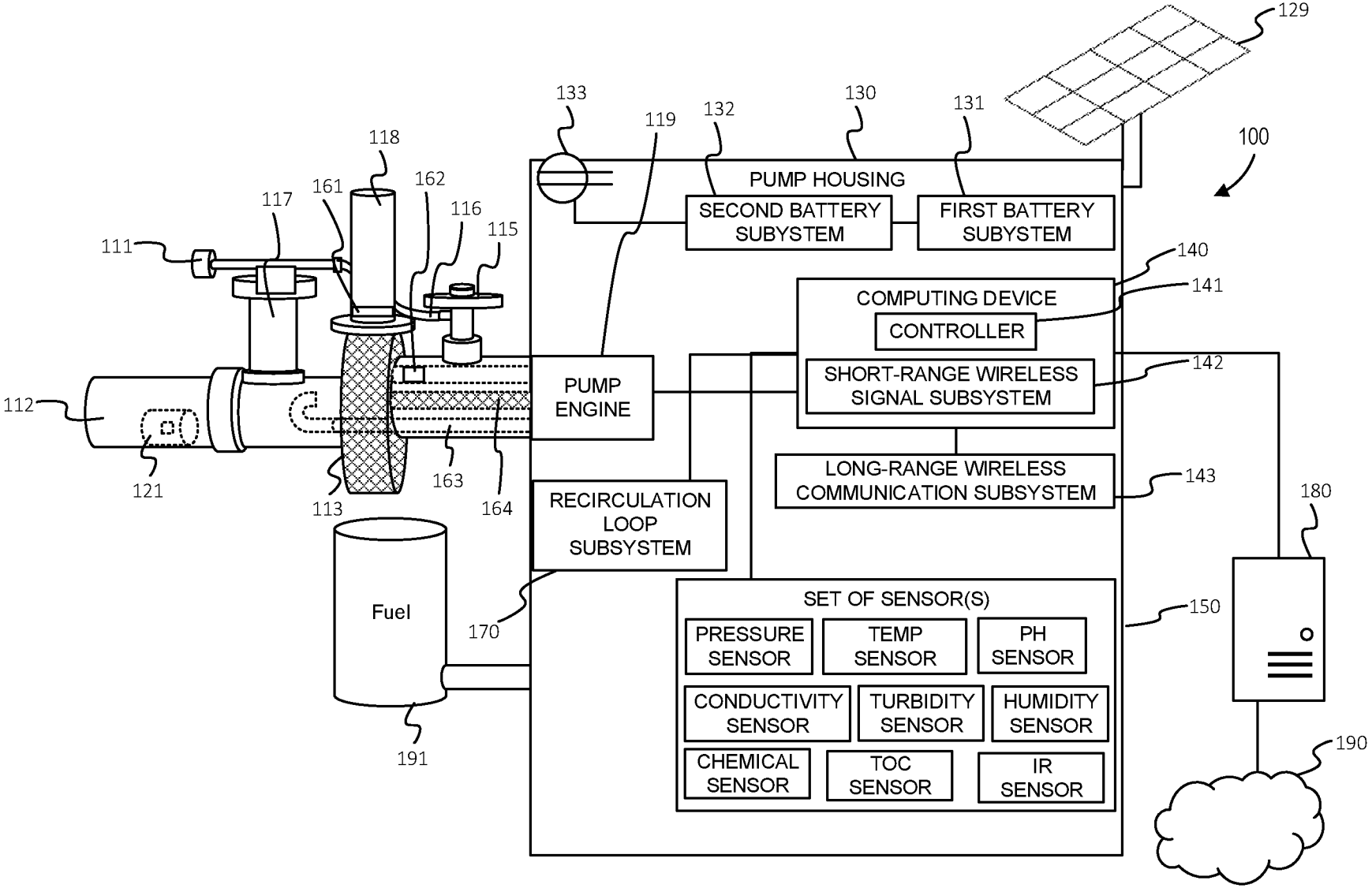
FIG. 1 is a diagram of an electronic pump system using the present techniques, in accordance with some embodiments.

While the present techniques are susceptible to various modifications and alternative forms, specific embodiments thereof are shown by way of example in the drawings and will herein be described in detail. The drawings may not be to scale. It should be understood, however, that the drawings and detailed description thereto are not intended to limit the present techniques to the particular form disclosed, but to the contrary, the intention is to cover all modifications, equivalents, and alternatives falling within the spirit and scope of the present techniques as defined by the appended claims.

DETAILED DESCRIPTION OF CERTAIN EMBODIMENTS

To mitigate the problems described herein, the inventors had to both invent solutions and, in some cases just as importantly, recognize problems overlooked (or not yet foreseen) by others in the field of electronic pumps. Indeed, the inventors wish to emphasize the difficulty of recognizing those problems that are nascent and will become much more apparent in the future should trends in industry continue as the inventors expect. Further, because multiple problems are addressed, it should be understood that some embodiments are problem-specific, and not all embodiments address every problem with traditional systems described herein or provide every benefit described herein. That said, improvements that solve various permutations of these problems are described below.

Some embodiments include an electronic pump that may obtain sensor measurements, operational parameters, or other values to meet a target state. In many cases, the pump may be controlled to achieve a target state. For example, some embodiments may modify operations of the pump to pump only from a main pipe, increase discharge pressure by activating a recirculation valve, or perform other adjustments to meet a target state. A target state may include a target discharge temperature, target discharge pressure, target flow rate, or the like. Furthermore, some embodiments may include a computing device storing program instructions that cause the pump to update operations to meet a target state in the event of a loss in communication with a wireless mesh network.

In some embodiments, a computing device of the pump may modify operations of the pump engine to optimize heat exchange based on temperature measurements of the pump. For example, in response to a determination that a fluid temperature of a fluid discharge stream is outside the bounds of a target fluid temperature, an electronic pump may increase a flow rate of heated material through a heat exchanger in a recirculation loop subsystem. In some embodiments, the electronic pump may respond to a phenomenon detected using a learning operation, where the learning operation may be configured to detect long-term phenomena that may be difficult to detect using other methods. In some embodiments, the learning operation or other operation may modify a plurality of operational parameters in sequence to satisfy a set of target states. It should be understood that the satisfaction of a set of criteria may should be interpreted in the context of a subsequent consequence of satisfying the set of criteria, and should not be interpreted as an explicit Boolean statement unless otherwise indicated. For example, some embodiments may satisfy a set of criteria that causes the modification of pump operations by not satisfying an explicitly encoded set of "IF" statements in a routine written in computer code.

FIG. 1 is a diagram of an electronic pump system using the present techniques, in accordance with some embodiments. The electronic pump 100 includes a vacuum inlet 111, which may allow air or another gas or gas mixture to flow through a fluid level pipe 117. The height of fluid through the fluid level pipe 117 may measure a fluid level of an inlet pipe 112. A diaphragm vacuum pump 115 may be activated when a liquid in the fluid level pipe 117 reaches a certain fluid level via the vacuum hose 116 to reduce pressure or otherwise reduce the risk of mechanical damage to the electronic pump 100. In some embodiments, other vacuum systems may be used. For example, an ejector-jet pump such as an aspirator (i.e., "venturi pump") may be used to reduce pressure in the electronic pump 100. During a set of pumping operations, the rotation speed of a pump rotor 113 may be increased to increase the amount of fluid being pumped from the inlet pipe 112 to a discharge pipe 118. In some embodiments, a pump engine 119 in a pump housing 130 may provide the mechanical energy to move the pump rotor 113.

The electronic pump 100 includes a sensor 121 in the inlet pipe 112 to provide pressure measurements, temperature measurements, humidity measurements, or other measurements to the computing device 140, described further below. In some embodiments, the sensor 121 may be or otherwise include a multi-sensor device such as the multi-sensing device 500 of FIG. 5, further described below. The computing device 140 may include one or more forms of local memory storage, such as a solid-state drive, a flash card, an SD card, or the like. While a sensor 121 is shown inside of the inlet pipe 112, other embodiments are possible. For example, some embodiments may re-position the sensor 121 in another portion of the electronic pump 100 or include another sensor in a different section of the electronic pump 100, such as within the fluid level pipe 117, within a recirculation loop discharge pipe 163, or the like.

The electronic pump 100 may obtain power from one or more energy sources such as a photoelectric device 129, a fuel source 191, or an external electrical power source. For example, the pump housing 130 is shown as being attached to the photoelectric device 129, which may be or otherwise include a solar panel. The photoelectric device 129 may be electrically connected to a first battery subsystem 131, which may include one or more batteries. In some embodiments, batteries of the first battery subsystem 131 may be charged by a solar panel of the photoelectric device 129. In some embodiments, the photoelectric device 129 may be electrically connected to a second battery subsystem 132, which may be identical to or different from the first battery subsystem 131. For example, the first battery subsystem 131 may include two 24-Volt lithium-ion batteries, and the second battery subsystem 132 may include a 12-Volt lead-acid battery. Each of the batteries of the first battery subsystem 131 or second battery subsystem 132 may include batteries made from various types of material and may include rechargeable batteries. Example batteries may include lithium-ion batteries, nickel-cadmium batteries, or various other types of batteries.

In some embodiments, the batteries may be used to power different processes to increase pump performance and safety. For example, the first battery subsystem 131 may be used to power a computing device 140 used to perform automation operations, and the second battery subsystem 132 may be used to perform electrical operations to maintain actual pump operations such as providing the ignition for a pump engine. In some embodiments, the first battery subsystem 131 and second battery subsystem 132 may be power-balanced with respect to each other. For example, electricity from the photoelectric device 129 may be used to power the first battery subsystem 131 until the first battery subsystem 131 reaches a stored energy threshold. The photoelectric device 129 may then be used to power the second battery subsystem 132 until the second battery subsystem 132 reaches a second stored energy voltage threshold or is fully charged. In addition, one or both of the first battery subsystem 131 and second battery subsystem 132 may power an outlet 133, which may be used to power an external lighting system, external computing system, or another external system. In some embodiments, data to or from the computing device 140 may also be transferred via the outlet 133. For example, some embodiments may send data from the computing device 140 in the form of electrical pulses transmitted through the outlet 133.

As discussed above, the electronic pump 100 may include the pump rotor 113, which can be powered by the pump engine 119 via the rotor shaft 164. In some embodiments, the pump engine 119 may be powered by the first battery subsystem 131, second battery subsystem 132, an external electrical power source, or a fuel source 191. For example, the fuel source 191 may provide diesel fuel for the pump engine 119. In some embodiments, the rate at which fuel is provided to the pump engine 119 may control the volumetric flow rate of a fluid flowing through the electronic pump 100 by controlling the pump rotation speed. In some embodiments, the rate at which fuel is provided to the pump engine 119 may be an operational parameter of the electronic pump 100.

The pump housing 130 may be used to house some or all of a computing device 140. The computing device 140 may include a programmable logic controller (PLC), a processor, fixed memory storage (e.g., an installed solid-state drive), removable memory storage (e.g., a removable memory card), or the like. The computing device 140 may also include a short-range wireless message subsystem 142, which may include a device to transmit and receive one or more short-range wireless messages such as a Bluetooth signal, a WiFi signal, a near-field communication (NFC) signal, a radiofrequency identification (RFID) signal, or the like. In some embodiments, the computing device 140 of the electronic pump 100 may communicate with one or more electronic devices such as digital sensors using various I/O equipment, such as a ModBus RS-485 serial bus or RS-132 bus, either which may be configured to support the ModBus RTU 1 protocol.

In some embodiments, the computing device 140 may be in communication with a long-range wireless communication subsystem 143 such as a Long Range ("LORA") network or another low-power wide area network ("LPWAN"). While the long-range wireless communication subsystem 143 is shown in the pump housing 130 as being separate from the computing device 140, some embodiments may include a computing device that includes the long-range wireless communication subsystem 143. The pump housing 130 may also include a recirculation loop subsystem 170 that pressurizes, heats, or cool fluids that flow through the electronic pump 100. In some embodiments, the recirculation loop subsystem 170 may include a set of heat exchangers, direct heating elements, or other components that may be in thermal contact with the fluid flowing into the electronic pump 100, as further described below.

In some embodiments, the computing device 140 may be in communication with a server 180 in connection with a cloud system 190. In some embodiments, the server 180 or an application executing on the cloud system 190 may receive data or instructions from the computing device 140, transmit data or instructions to the computing device 140, or the like. For example, the server 180 may perform a set of learning operations based on measurements from the electronic pump 100 and transmit results of the learning operation (e.g., neural network weights, biases, hyperparameters, or the like) to the computing device 140. The computing device 140 may then use the results of the learning operation to determine operational parameters of the electronic pump 100.

The pump housing 130 may include a set of sensors 150 that can be in communication with the computing device 140. The set of sensors may include one or more sensors and may include sensors of one or more various types of sensors. Example sensors may include pressure sensors, temperature sensors, pH sensors, conductivity sensors, turbidity sensors, humidity sensors, chemical sensors, total organic content (TOC) sensors, infrared (IR) sensors, total dissolved oxygen (ToD) sensors, or the like. The sensors may be placed in various positions of a pump system. For example, a first temperature sensor may be positioned before a valve and a second temperature sensor may be positioned after the valve, where "before" and after" are stated with respect to a fluid flow direction through the valve. These sensors may be used to provide measurements that indicate one or more fluid properties, an operational state of equipment that had previously processed fluid flowing through inlet pipe 112, a state of one or more equipment components, or the like. For example, the total dissolved oxygen sensor may be used to monitor water quality or provide indication on the performance of a water treatment process providing flow into the pump. Various other sensors may provide measurements that indicate properties such as temperature, flow rate, pH, pressure, precipitate content, ratio content of atoms or molecules such as calcium content or carbonate content, or the like.

The electronic pump 100 may include one or more automated valves such as the discharge valve 161 or the recirculation valve 162. In some embodiments, fluid flowing in from the inlet pipe 112 may be sent to the discharge pipe 118 through the discharge valve 161. Alternatively, or in addition, fluid flowing in from the inlet pipe 112 may be sent through the recirculation loop subsystem 170 by activating the recirculation valve 162 or otherwise configuring the recirculation valve 162 to change a volumetric flow rate of fluid flowing through the recirculation loop subsystem 170. In some embodiments, some or all of the automated valves may be controlled by the computing device 140. For example, the computing device 140 may actuate the recirculation valve 162 to increase flow through the recirculation valve 162. Fluid flowing through the recirculation valve 162 may be heated by the recirculation loop subsystem 170 and then diverted into an inlet stream from the inlet pipe 112 via the recirculation loop discharge pipe 163. In some embodiments, the electronic pump 100 may include additional valves that enable recirculation of fluids without using the recirculation loop subsystem 170 or allows the recirculation of a first portion of fluids that are not heated or cooled by recirculation loop subsystem 170 and the recirculation of a second portion of fluids that are heated or cooled by recirculation loop subsystem 170. As further discussed below, recirculation of fluids may provide a means of changing a fluid temperature or pressure.

Figure 2:
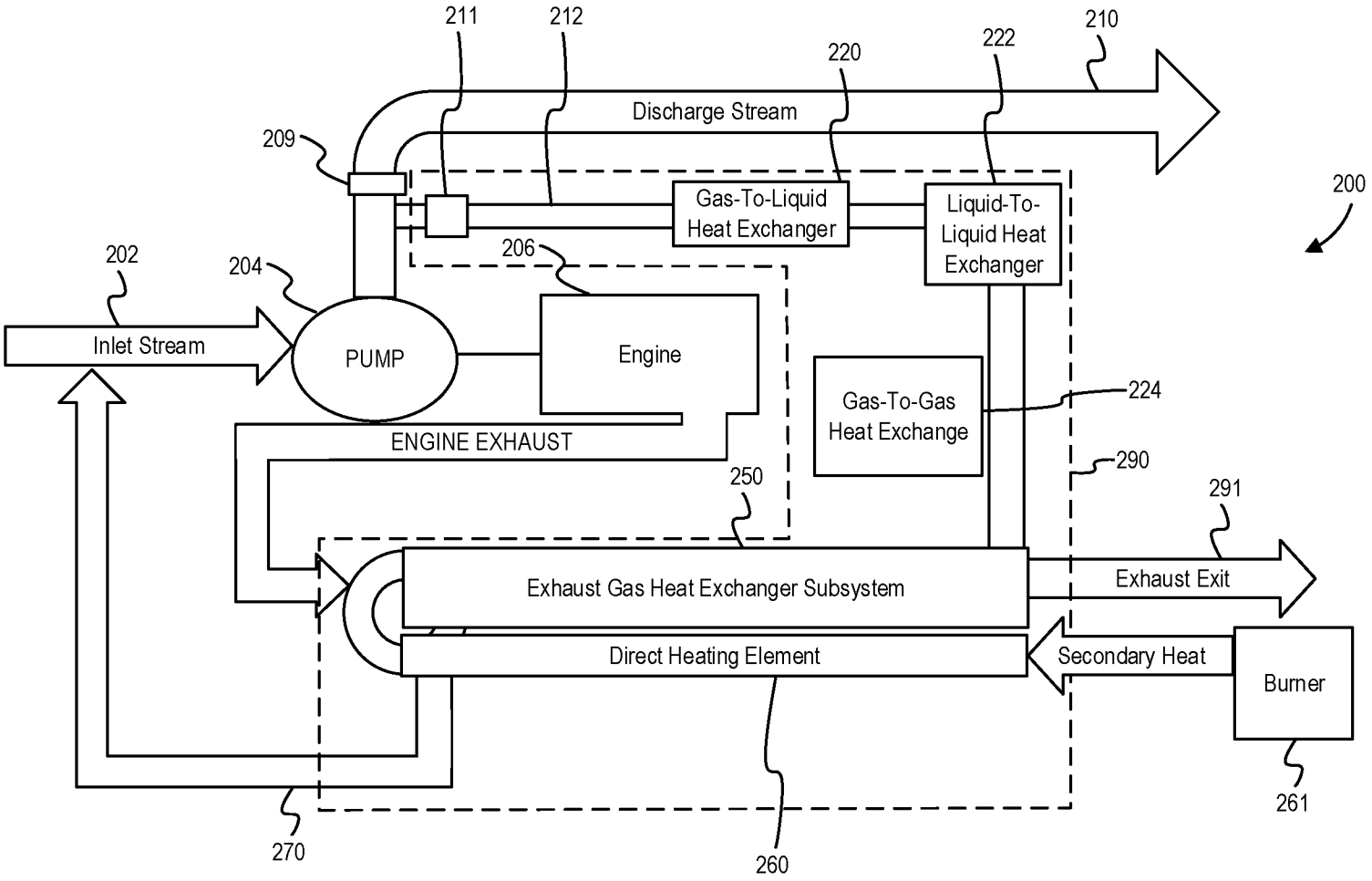
FIG. 2 is a conceptual diagram of fluid flow through a recirculation loop subsystem of an electronic pump, in accordance with some embodiments.

FIG. 2 is a conceptual diagram of fluid flow through a recirculation loop subsystem of an electronic pump, in accordance with some embodiments. The inlet stream 202 may represent a process fluid flowing to a pump rotor of the pump 204, which may be powered by an engine 206. The engine 206 may be a gasoline engine, diesel engine, or the like. In some embodiments, the process fluid may proceed directly to flow through a discharge valve 209, where the flow of the process fluid may be represented by a fluid discharge stream 210 flowing through a discharge pipe of the electronic pump. For example, the discharge valve 209 may be opened to permit process fluid through the discharge valve into the fluid discharge stream 210.

In some embodiments, process fluid flowing through the inlet stream 202 may flow through a recirculation valve 211 into the recirculation loop 290. A portion of the process fluid may be diverted to enter a recirculation stream 212 flowing through the recirculation loop 290, where the recirculation loop 290 may include the recirculation loop subsystem 170 described above. Fluid in the recirculation stream 212 may proceed through a set of heat exchangers that include a gas-to-liquid heat exchanger 220, a liquid-to-liquid heat exchanger 222, or a gas-to-gas heat exchanger 224. The gas-to-liquid heat exchanger 220 may use the process fluid flowing through the recirculation stream 212 as a cooling medium for a fluid-to-air cooling process, where a heated material provided by a component of a pump (e.g., a compressor) and the process fluid in the recirculation stream 212 may exchange heat. Various arrangements in the set of heat exchangers may provide a means of thermal contact between the heated material and the process fluid, which may result in the cooling of the heated material and the heating of the process fluid. For example, superheated air or some other gas mixture may be pumped through a tube from a compressor (e.g., a turbocharger, and the fluid in the recirculation stream 212 may be pumped through a radiator in the tube. Alternatively, or in addition, the heated material may be pre-cooled by flowing the heated material through a radiator exposed to open air. In some embodiments, the heated material may be heated air provided by a turbocharger or other compressor.

The liquid-to-liquid heat exchanger 222 may further heat the process fluid in the recirculation stream 212 using a liquid-heated material from the electronic pump, fluid flowing through a closed flow system, or other heated substance. For example, process fluids may flow through a first half-pipe of a pipe of the liquid-to-liquid heat exchanger 222. The liquid-to-liquid heat exchanger 222 may include the first half-pipe and a second half-pipe, where the first half-pipe and the second half-pipe are separated by a separation plate having a high thermal conductivity, and where a counter-current flow of heated material from the engine may flow through the second half-pipe. The heated material may include engine coolant from the engine 206, a super-heated amount of water siphoned from the recirculation stream 212, or the like. In some embodiments, the liquid heated material may be or otherwise include an internal coolant of the engine, where the internal coolant may include water, steam, alcohol(s) such as glycol, gases or gas mixtures (e.g., air, ammonia, carbon dioxide), liquified versions thereof, or the like. Thermal contact between the process fluid and the heated material may cool the heated material and heat the fluid, which may both warm the process fluid and cool the engine 206 or other components of a pump.

In some embodiments, the process fluid in the recirculation stream 212 may be heated by the gas-to-gas heat exchanger 224. The gas-to-gas heat exchanger 224 may be used to cool gaseous fluids flowing in the recirculation stream 212. For example, the gas-to-gas heat exchanger 224 may include an air-to-air cooling system, wherein boiling water or super-heated water vapors in the process fluid may be further heated by exhaust gas from the engine 206. In some embodiments, the gas-to-gas heat exchanger 224 may include one or more radiators through which the fluids in the recirculation stream 212 may flow.

In some embodiments, the fluid in the recirculation stream 212 may be heated by an exhaust gas heat exchanger subsystem 250. The exhaust gas heat exchanger subsystem 250 may include a cooling loop for engine exhaust gases to flow through from one side and flow the fluid in the recirculation stream 212 as a countercurrent from the other side. Alternatively, or in addition, the exhaust gas heat exchanger subsystem 250 may allow exhaust gas from the engine 206 to pass through a coil or other tubing within which the process fluid may flow. In some embodiments, after using the engine exhaust in the set of heat exchangers, the engine exhaust may exit the pump through the exhaust exit stream 291. By heating the process fluid in the recirculation stream 212 with exhaust gas from the engine 206 or coolant fluid from the engine 206, operations of an electronic pump may be made more efficient. Benefits of using a heat exchanger that uses heated material from the engine or other component of the pump may include heating the process fluid, increasing fuel efficiency, and reducing the risk of equipment damage/degradation caused by an elevated equipment temperature.

In some embodiments, the fluid may pass through a direct heating element 260 for additional heating, where a burner 261 or another combustion system may be used to heat fluids in the recirculation stream 212. In some embodiments, the burner 261 may provide a flame in a tubular element of the direct heating element 260, where the recirculation stream 212 may be further heated by the tubular element. In some embodiments, the direct heating element 260 may be heated using methods other than combustion, such as electrical heating.

In some embodiments, a set of sensors may be placed at one or more positions throughout the flow system 200 of an electronic pump. For example, temperature sensors, humidity sensors, and pressure sensors may be distributed on or in a pipe through which the inlet stream 202 may flow, a pipe through which the fluid discharge stream 210 may flow, directly downstream the recirculation valve 211 along the recirculation stream 212, between the gas-to-liquid heat exchanger 220 and the gas-to-gas heat exchanger 224 along the recirculation stream 212, and along the recirculation discharge stream 280. As further discussed below, some embodiments may store each sensor measurement as its own value in a data structure of a local memory of a computing device of the electronic pump. Alternatively, or in addition, some embodiments may aggregate the individual sensor measurements to a set of aggregated values corresponding to the sensors to determine statistics such as a measure of central tendency or measure of variation. For example, some embodiments may determine a running total for each sensor of a set of pressure sensors and divide each respective total value by their respective number of measurements in a time period to determine a mean average pressure for each of the sensors.

The use of a fluid recirculation system may be advantageous when a target state includes a greater pumping pressure or when an environment requires greater heat conservation. By recirculating fluids, heat generated by the engine that may have been otherwise wasted is instead used to protect pipes of an electronic pump from freeze-related damage and properties of a process fluid may be kept in a target range by heating. In some embodiments, process fluid in the recirculation stream 212 may also circulate around an exhaust manifold, which may help keep the engine 206 warm for a longer duration when the engine itself is idle or may help warm the engine faster to establish a target operational parameter. While not pictured, some embodiments may include a plurality of recirculation valves, where opening a first recirculation valve may result in the recirculation of a fluid without additional heating of the fluid by a heat-exchanger in the pump, and opening a second recirculation valve may result in the recirculation of a fluid with additional heating of the fluid by a heat-exchanger in the pump. The process fluid in the recirculation stream 212 may then exit the recirculation loop 290 via the recirculation loop discharge stream 270, where the recirculation loop discharge stream 270 may flow through a recirculation loop discharge pipe. For example, the process fluid may flow through a pipe similar to or identical to the recirculation loop discharge pipe 163.

Some embodiments may control valves, pumps, or other actuators of the flow system 200 to satisfy a target state. For example, some embodiments may receive instructions that indicate that a target temperature in the recirculation stream 212 is 70 degrees Celsius and determine that a temperature sensor in the recirculation stream 212 indicates a temperature of 60 degrees Celsius. Some embodiments may provide instructions to actuate a valve that increases heating fluid through the liquid-to-liquid heat exchanger 222 or another element of the flow system 200 to increase the temperature of a fluid in the recirculation stream 212. Alternatively, or in addition, some embodiments may provide instructions to increase the temperature of one or more heating elements in the flow system 200. The instructions may be provided from an onboard computer or from an off-site computer system (e.g., a computer communicating via a wireless system). Some embodiments may perform one or more operations described in this disclosure to sense or modify the operations of a component of the flow system 200.

Figure 3:
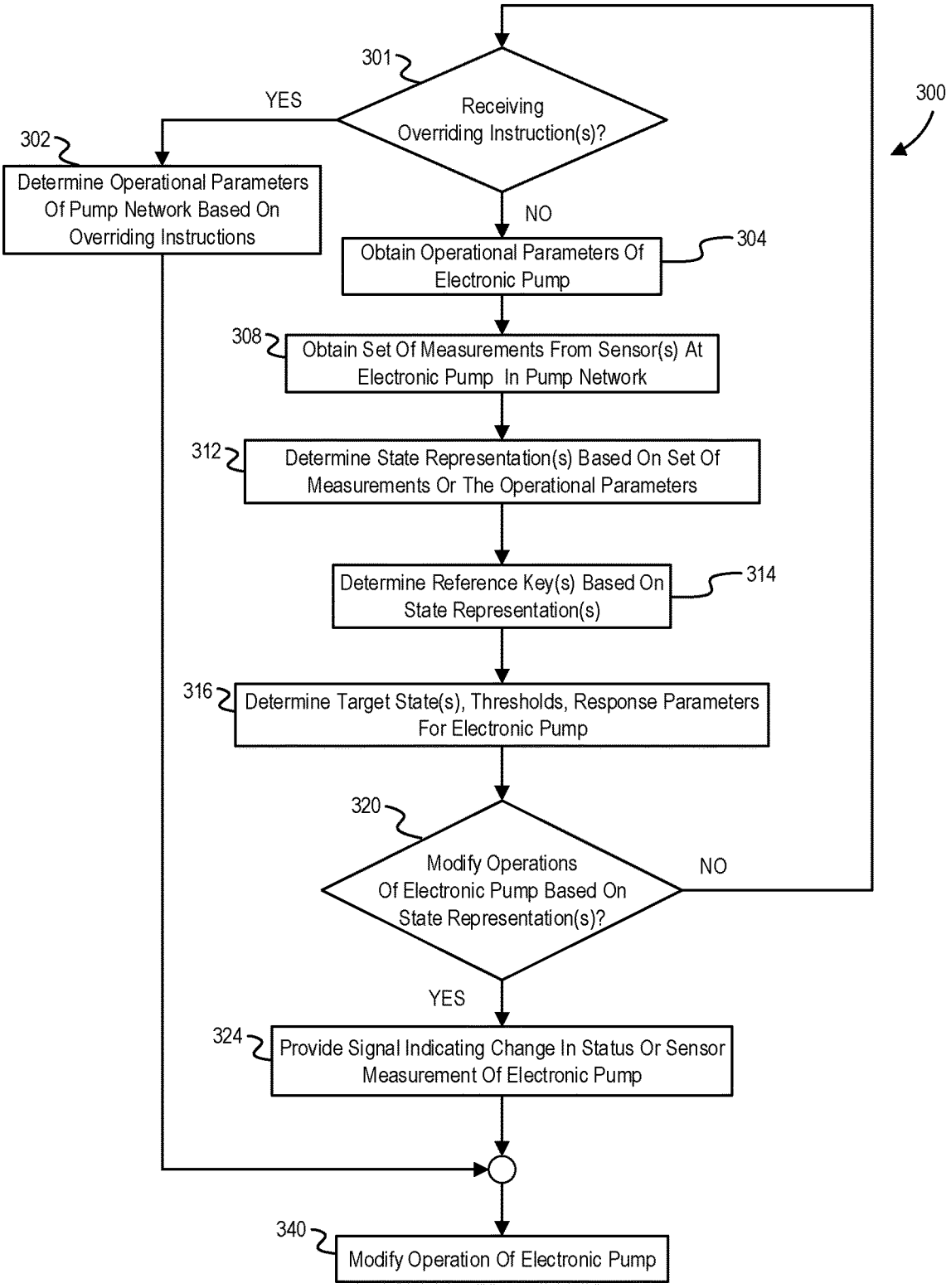
FIG. 3 is a flowchart of operations to control an electronic pump, in accordance with some embodiments.
Figure 4:
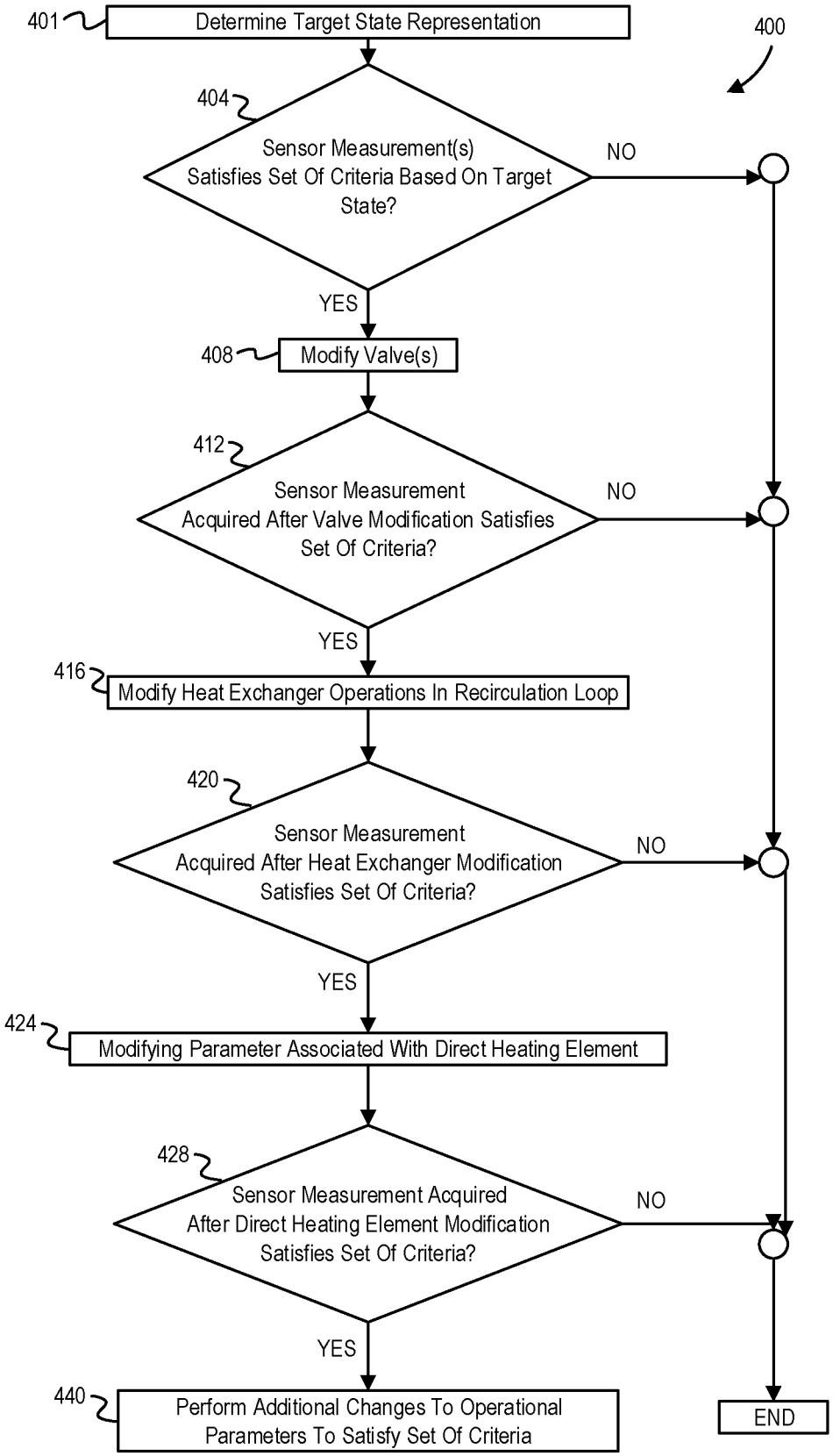
FIG. 4 is a flowchart of operations to modify an electronic pump operation based on a target state, in accordance with some embodiments.

FIG. 3 and FIG. 4 show the process 300 and process 400, which may be implemented by a system that includes computer code stored on a tangible, non-transitory, machine-readable medium, such that when instructions of the code are executed by one or more processors, the described functionality may be effectuated. Instructions may be distributed on multiple physical instances of memory, e.g., in different computing devices, or in a single device or a single physical instance of memory, all consistent with use of the singular term "medium." In some embodiments, the system may include a computing device of a pump that stores or executes some or all of the computer code to perform one or more operations described below. For example, a computing device of the electronic pump 100 may execute some or all of the computer code. Alternatively, or in addition, the system may include a computing device of an on-premise server or a cloud system that stores or executes some or all of the computer code. For example, the system may include the server 180 or an application executing on a provisioned server of the cloud system 190 to execute some or all of the computer code to perform one or more operations described below.

In some embodiments, the operations may be executed in a different order from that described. For example, a system may obtain a set of measurements as described in block 308 before obtaining operational parameters of a pump as described in block 304. Similarly, operations described for block 412 may be performed before operations described for block 404. In some embodiments, operations may be executed multiple times per instance of the process's execution, some operations may be omitted, additional operations may be added, some operations may be executed concurrently and other operations may be executed serially, none of which is to suggest that any other feature described herein is not also amenable to variation. For example, some embodiments may perform operations described in block 320 and 324 without performing operations described for block 312, 314, or 316.

FIG. 3 is a flowchart of operations to control an electronic pump, in accordance with some embodiments. In some embodiments, the process 300 may include determining whether a set of overriding instructions are received, as indicated in block 301. The set of overriding instructions may be carried by a wireless message such as a long-range wireless signal (e.g., a sub-gigahertz signal), a short-range wireless signal, a multi-channel signal, or the like. The set of overriding instructions may also be sent via a wired connection between an electronic device and an electronic pump. In some embodiments, an overriding instruction may include instructions or values that change the operational parameter of the electronic pump based on a first value of the overriding instruction that may be encoded to directly correspond with an operational parameter of the pump. For example, the overriding instructions may include a value encoded as a first level of a pump rotation speed and cause an electronic pump to pump at a rotation speed corresponding with the first level of the pump rotation speed. In some embodiments, the electronic pump may receive data or updates without receiving overriding instructions, and instructions may be sent to an electronic pump without including overriding instructions. For example, the instructions may include a target state, such as a target discharge pump pressure. As further discussed below, the target state received by an electronic pump may be achieved based on one or more changes in a set of operational parameters of the electronic pump.

In some embodiments, the system may determine that overriding instructions have been received based on a determination that a set of values in a signal includes an encoding to indicating that the electronic pump should operate one or more components based on the values in the signal. For example, the electronic pump may receive a first wireless 16-bit signal that includes a first value "60105." which may act as an override indicator interpretable by the electronic pump to indicate that the next value may represent a rotation speed that should be used in place of a previous rotation speed. In response to receiving a wireless message or another type of signal that includes an indicator interpretable by the electronic pump as instructions to use a value that should be used in place of a previous value, the system may determine that overriding instructions have been received. If the system determines that overriding instructions are received at an electronic pump, operations of the process 300 may proceed to block 302. Otherwise, operations of the process 300 may proceed to block 304.

At block 302, the system may determine operational parameters based on the overriding instructions. In some embodiments, the overriding instructions may include operational parameters to replace previously-determined operational parameters. For example, the electronic pump may receive a first wireless message that includes a first value "60105" and a second wireless message that includes a second value "10," where the first value represents an indicator corresponding with instructions to override a previous rotation speed with an overriding rotation speed, and the second value represents the overriding rotation speed. In response, the electronic pump may change its rotation speed from a previous rotation speed to a rotation speed of 10 rotations per minute (RPM). Various other operational parameters of an electronic pump may be set based on the overriding instructions, such as parameters to control a valve, modify a pumping speed, shut down a pump, modify the operations of a heating element, or the like.

In some embodiments, the process 300 may include obtaining a set of operational parameters of the electronic pump in a fluid distribution network, as indicated in block 304. A fluid distribution network may be any combination of pipes, pumps, or other possible conduits or movers of a fluid in a set of enclosed spaces that transport An operational parameter of a pump may be a controllable input for an electronic pump that may cause the activation, modification, or deactivation of one or more components of the pump. For example, obtaining the operational parameter of an electronic pump may include obtaining a rotation speed, a power consumption, a fluid filter parameter, a setpoint for a pressure, setpoint for a temperature, a solute injection quantity, or the like. In some embodiments, obtaining the set of operational parameters may include obtaining an initial set of default operational parameters. Alternatively, or in addition, obtaining the set of operational parameters may include obtaining the parameters after the activation of a pump in real-time. In some embodiments, as further described below, an operational parameter may be normalized.

In some embodiments, the process 300 may include obtaining a set of measurements acquired by one or more sensors of an electronic pump, as indicated in block 308. A sensor of the electronic pump may be any sensor attached to the electronic pump, connected by a wired connection to an electrical component of the electronic pump, or otherwise within the proximity of and in communication with the electronic pump (e.g., within 100 meters of the electronic pump and in communication via a WiFi network). The set of measurements may include various measurements, such as a flow rate, a fluid temperature, a fluid pressure, a fluid resistivity measurement, or the like. For example, the set of measurements may include a discharge pressure of the fluid at a pump discharge pipe and an inlet pressure of the fluid at the inlet pipe. In some embodiments, a plurality of measurement types may be measured concurrently. For example, a computing device of an electronic pump may obtain a discharge pressure, a fluid temperature, and a resistivity measurement every 30 seconds over a year-long period.

In some embodiments, the system may stop the collection or reporting of data if the operational parameters indicate non-use or abnormal use of the electronic pump. For example, if the operational parameters of a pump indicate that the electronic pump is idling (e.g., a pump's rotation speed is below a rotation threshold), operations to obtain one or more measurements of the set of sensor measurements may be stopped. Once the operational parameters of the pump indicate that the pump is operating to pump fluids again (e.g., the pump's rotation speed is above the rotation threshold), obtaining measurements using one or more of the operations described below may be resumed. By stopping data collection during abnormal pump activity, some embodiments may reduce data consumption or wireless bandwidth consumption.

Some embodiments may apply a set of pre-processing filters to sensor measurements to reduce the effect of sensor noise or other sources of error when obtaining the sensor measurements. For example, some embodiments may store more than two, more than 10, more than 100, or more 1000 measurements at different time points based on a sample rate(s) indicating the time between each measurement. Some embodiments may then determine whether to include one or more measurements as part of the set of measurements if the change over time satisfies a change-over-time-threshold, which may be determined based on a ratio between the measurement and the sample rate. In some embodiments, if the change over time is greater than a change-over-time-threshold, some embodiments may determine this change to be sensor error and include instructions to ignore the new measurements. For example, some embodiments may average a measured temperature over a 30-second period to determine an average temperature value for the 30-second duration and set the change-over-time-threshold to be equal to be 150% of the average temperature value for any set of 30-second measurements. If a new measured temperature is measured within 30 seconds after the duration corresponding to the average temperature measurement and exceeds 150% of the average temperature value, the new measured temperature may be discarded.

In some embodiments, the set of measurements or the set of operational parameters may be stored in a computer memory system attached to an electronic pump. For example, the measurements from a PLC of a sensor may be stored in one or more Modbus registers of the PLC. In some embodiments, the measurements may then be transmitted to other computing devices of a fluid distribution network via a wireless mesh network. For example, some embodiments may perform operations to wirelessly send messages, provide sensor outputs, and respond to sensor measurements using one or more operations described in patent application U.S. 62/964,213, titled WIRELESS MESH FOR FLUID DISTRIBUTION NETWORK, filed 22 Jan. 2020, which is incorporated herein by reference. Alternatively, or in addition, the measurements, parameters, or other values from an electronic pump may be transmitted to other systems for reporting, anomaly-detection, or analytical purposes. For example, some embodiments may report a set of measurements from an electronic pump to a remote computer system via a set of wireless transmitters, where the remote computer system may use a set of machine learning operations to determine whether to categorize the electronic pump as failing or as likely to fail.

In some embodiments, the set of measurements may include measurements from a multi-sensing device. A multi-sensing device may include a pressure sensor subsystem and a vacuum sensor subsystem ("low-pressure sensor"). In some embodiments, the pressure sensor subsystem may measure pressures greater than a maximum pressure measurement provided by the vacuum sensor subsystem. The vacuum sensor subsystem may measure pressures less than a minimum pressure measurement provided by the vacuum sensor subsystem. The pressure sensor subsystem may provide measurements of pressures greater than 100,000 Pascals (Pa), and the vacuum sensor subsystem may provide measurements of pressures less than or equal to 100,000 Pa. In some embodiments, the vacuum sensor may be provide pressure measurements less than 50,000 Pa, less than 10,000 Pa, less than 1000 Pa, or the like.

In some embodiments, operations of the multi-sensing device may include protecting the vacuum sensor subsystem or otherwise disabling the vacuum sensor until the pressure sensor of the multi-sensing device falls below a pressure measurement threshold. For example, the multi-sensing device may include circuitry that reports pressure measurements from the pressure sensor subsystem when the measured pressure is greater than 100,000 Pa, and switches to reporting pressure measurements from the vacuum sensor when the measured pressure is less than 100,000 Pa. As further discussed below, switching between measurement readings may increase the accuracy and device lifespan of the vacuum sensor subsystem. As further discussed below, the structure, arrangement, and operations of the multi-sensing device may be modified to increase compatibility with the possible extreme environments of pipes in or attached to an electronic pump.

In some embodiments, the system may obtain an additional set of measurements acquired by one or more sensors of one or more other pumps or standalone sensors in a fluid distribution network. The additional measurements may be made from sensors distributed anywhere along or at either or both ends of the fluid distribution network. For example, the additional measurements may be acquired by sensors attached to pumps, pipes or other fluid conduits, a fluid source, or fluid destination. The additional set of measurements may include various types of measurements. For example, the additional set of measurements may include a flow rate, a fluid temperature, a fluid pressure, a fluid resistivity measurement, a size distribution of particulates in the fluid, or the like from one or more sensors.

Some embodiments may process data provided by a first pump at a computing device of a second electronic pump before sending a summary value determined from measurements or other data provided by both pumps to a third electronic pump or another remote computing device. For example, a first electronic pump may wirelessly transmit a set of temperature values to second electronic pump. The second electronic pump may then determine a summary value such as a measure of central tendency or a measure of deviation.

In some embodiments, the additional set of measurements may be provided to a computing device of the electronic pump or to another computing device. Providing the set of measurements or other data may include transmitting the data over a LORA network or another WAN system. In some embodiments, data transfer may depend on a measured connection quality. For example, the electronic pump 100 may be or otherwise include a LORA network node and may receive values such as a fluid temperature value via the LORA network. By wirelessly receiving measurements acquired by sensors distributed across different locations of a fluid distribution network, a computing device of an electronic pump may detect anomalies that would have been more difficult to detect using sensors limited to a single location. Measurements, instructions, or other data may be wirelessly sent or received by an electronic pump using a multi-bandwidth approach that includes short-range and long-range systems using systems and methods described in patent application U.S. 62/964,220, titled MULTI-BANDWIDTH COMMUNICATION FOR FLUID DISTRIBUTION NETWORK, filed 22 Jan. 2020, which is incorporated herein by reference.

In some embodiments, the process 300 may include determining a set of state representations based on the set of measurements or the operational parameters, as indicated in block 312. In some embodiments, the set of state representations may include the operational parameters or the set of measurements. For example, if the set of measurements includes a first pressure measurement, the set of state representations may include the first pressure measurement. Alternatively, or in addition, the set of state representations may be determined using one or more functions that uses the set of measurements as function inputs. For example, the set of state representations may include a measure of central tendency (e.g., mean, median, mode) of a set of flow rate measurements, temperature measurements, and pressure measurements acquired by sensors of an electronic pump. In some embodiments, the set of state representations may be determined by calculating a difference between different values of a set of measurements. For example, a set of state representations may be equal to or otherwise include the difference between the temperature value of a process fluid at the inlet pipe of an electronic pump and the temperature value of the process fluid at the discharge pipe of the electronic pump.

In some embodiments, the set of state representations may include the operational parameters. For example, if the operational parameter includes a first rotation speed, the set of state representations may include the first rotation speed. Alternatively, or in addition, the set of state representations may be determined using one or more functions that take the operational parameters or first set of measurements as inputs. For example, the set of state representations for a pump may include a mean average or another measure of central tendency of a power consumption values of a pump. In some embodiments, the system may populate a library of values to associate one or more thresholds with one or more reference keys (further described below), where the reference key may be based on an operational parameter, and the thresholds may be based on the first set of measurements.

Some embodiments may normalize sensor measurements, determine statistics based on sensor measurements, or use other summary values based on sensor measurements to determine a set of state representations and corresponding thresholds. For example, some embodiments may obtain a sequence of five temperature measurements including 19.5 degrees Celsius, 20.5 degrees Celsius, 20.25 degrees Celsius, 19.75 degrees Celsius, and 20 degrees Celsius, resulting in 100 degrees Celsius as the sum of previous pressure measurements. Some embodiments may then determine a mean average (i.e., 20 degrees Celsius) as a state representation and further determine a set of thresholds based on the mean average. The set of thresholds may be used to detect or categorize an anomaly. For example, if the sum of a set of previous five temperature measurements is 100 degrees Celsius, the system may use the mean average value of 20 degrees Celsius and a pair of thresholds representing an allowable deviation of 25% (15 degrees Celsius and 25 degrees Celsius) to detect or categorize an anomaly. Some embodiments may store the sum of the measurements instead of each individual measurement, where the sum may then be used to determine mean values, other state representations, or thresholds based on the summary values. Some embodiments may perform operations such as deleting or otherwise discarding the individual measurements after the measurements are used to determine a sum or other summary value. By storing sums instead of individual values, some embodiments may reduce memory requirements and computation costs. Such reductions may increase the efficient use of memory and computing resources, which may be limited in computing devices associated with electronic pumps.

In some embodiments, a state representation may include a result determined from applying a function on a set of previous values to determine a summary value. For example, some embodiments may determine a state representation that includes a total volume of fluid pumped using flow rate measurements from a flowmeter. Various methods may be used to determine a total volume of fluid discharged by the pump. For example, some embodiments may include determining a volume of fluid discharged by taking a product of a flow rate measured in cubic centimeters per second and an interval of time between flow rate measurements such as 0.25 seconds to determine a fluid volume discharged for that time interval. Some embodiments may then store the sum of the volume discharged for each time interval to determine a total volume discharged. As described elsewhere in this disclosure, some embodiments may use the total volume of fluid discharged from an electronic pump or another result of a function applied to a set of sensor measurements as a state representation and compare the state representation to a threshold to determine if operations of the electronic pump should be modified.

In some embodiments, the set of state representations may be determined based on a time series that includes measurements made over time. The time series may include values for one or more types of measurements, such as pressure measurements, temperature measurements, flow rate measurements, density measurements, or the like. For example, a first time series may include a first set of temperature measurements from a first temperature sensor and a second set of temperature measurements from a second temperature sensor, where both the first and second set of temperature measurements may be concurrently acquired every 30 seconds over a 30-minute interval. In some embodiments, the time series may include data from three or more electronic pump sensors. For example, the time series may include flow rate measurements, pressure measurements, or temperature measurements from every sensor in an electronic pump.

In some embodiments, the set of state representations may be determined as being equal to or be otherwise based on one or more frequency values. The frequency values may include a first set of frequency values based on the first set of measurements and an additional set of measurements determined based on the additional set of measurements. Some embodiments may determine a set of frequency values from a set of measurements based on a Fast Fourier Transform (FFT) method. For example, a set of flow rate measurements may be used as part of a time series, and the five greatest frequency components, as determined by the FFT method, may be used as the state representation. By using transformation functions such as an implementation of a FFT method to determine state representations, some embodiments may use the state representations to filter out measurement noise.

In some embodiments, a set of state representations may include a set of values provided in a reduced dimensional form with respect to a set of measurements provided by sensors of an electronic pump. For example, some embodiments may collect a set of measurements from different sensors and perform principal component analysis to determine a principal component vector, where a state representation may include the vector. Alternatively, or in addition, the set of state representations may include an unmodified set of measurements. For example, the set of state representations may include a set of flow rate measurements and temperature measurements from a set of sensors. Using unmodified measurement values as state representations may increase the accuracy of certain data analysis operations. For example, using unmodified measurements may increase the accuracy of clustering operations based on the set of state representations if the set of state representations is equal to or otherwise includes a set of measurements.

In some embodiments, the process 300 may include determining a set of reference keys based on the set of measurements or the operational parameters, as indicated in block 314. Some embodiments may determine a reference based on a portion of a state representation, where the reference key may be a single value or a set of values (e.g., a vector). As described elsewhere in this disclosure, a reference key may be determined to reduce the computation resource cost of retrieving and sending data. For example, some embodiments may use the reference key as an index value to retrieve thresholds or other criteria values.

In some embodiments, a reference key may include an operational parameter such as a pump rotation speed, as measured in rotations-per-minute (RPM). As used herein, operational parameters or measurements may include normalized operational parameters or normalized measurements. For example, the rotation speed of a pump may be stored as a normalized value, where the pump rotation speed may be normalized based on a normalization constant for rotation speed (e.g., a maximum rotation speed in RPM). Some embodiments may then set the reference key to be equal to the normalized rotation speed and, as further described below, use the reference key to determine which set of values in a library of values to use for detecting or categorizing an anomalous state. Alternatively, or in addition, the reference key may include other operational parameters such as a value correlated with an aperture area of a valve, such as a ratio or an area value. For example, the reference key may include a value ranging between 0 to 10 that represents the area in square centimeter through a fluid may flow through a valve (e.g., a discharge valve, recirculation valve, or the like). As another example, the reference key may include a ratio between 0 and 1, representing an extent by which a valve is open, where 0.0 may indicate that the valve is closed and 1.0 may indicate that the valve is fully open.

As described elsewhere in this disclosure, a reference key may include or otherwise be based on a measurement, such as a discharge pressure, inlet pressure, or temperature. For example, the reference key may include a value correlated with an inlet temperature, which may be normalized based on a pre-set reference value for a temperature measurement (e.g., 373.15 degrees Kelvin). For example, a reference key or a value of the reference key may be determined by dividing a fluid temperature by 100 degrees Celsius. Some embodiments may determine one or more reference key values based on an operational parameter(s) and a sensor measurement(s). For example, the reference key may include a normalized pump rotation speed and a normalized temperature measurement, where the reference key may be stored as a vector, array of numbers, or the like.

In some embodiments, the operational parameter, measurement, or another value used as a reference key may be assigned into a specific bin of values using a binning method. A binning method may include various quantization methods that group data points within an interval into a single value of that interval. For example, each of a set of temperature measurements may be normalized, range between 0.0 to 1.0, may be binned into one of 10 intervals between zero and one. The values of 0.03 and 0.095 may both be binned into the first interval "0-0.1", which may be equivalent to being binned into the same state representation associated with the first interval. Other sizes of bins or numbers of bins may be used. For example, a reference range may be split into more than 10 bins, more than 40 bins, more than 100 bins, or the like. In some embodiments, if a reference key includes a vector, each element of the vector may be associated with and sorted into a bin of the same number of bins. Alternatively, some or all of the elements of the vector may be associated with a different number of bins such that a first element of the vector is sorted into one of a first number of bins and a second element is sorted into one of a second number of bins.

In some embodiments, the reference key may be associated with a portion of the state representation. For example, some embodiments may include a temperature difference as a state representation and may calculate the temperature difference based on a difference between a discharge temperature and inlet temperature of the electronic pump, where the electronic pump is operating at a first rotation speed. The system may normalize and assign the first rotation speed to a first bin. After computing the temperature difference, the system may store the temperature difference and associate the temperature difference with the first bin. By using a reference key of a data structure, data associated with the reference key may be retrieved far more efficiently and quickly when referencing the data structure.

In some embodiments, the process 300 may include determining a set of target states, thresholds, or response parameters, as indicated in block 316. In some embodiments, each target state of a set of target states may be or include a preset value stored in a memory of a computing device. In some embodiments, instructions sent to the electronic pump via a wireless signal may include a target state for the electronic pump that may have previously not been a target state for the electronic pump. For example, the electronic pump may receive a wireless signal indicating that a target discharge temperature is 50 degrees Celsius. In response, as further described below, the system may determine that a target state is 50 degrees Celsius and cause the electronic pump to modify its operational parameters to satisfy the target state. Example operational parameter changes may include opening a recirculation valve of a recirculation loop subsystem, increasing the flow through the recirculation valve, by increasing flow through a set of heat exchangers of the recirculation loop subsystem, or the like.

In some embodiments, an electronic pump of the system may include a plurality of operational modes, where each operational mode may include a set of thresholds, ranges, response parameters, target states, or set of instructions to determine operations of the electronic pump. For example, a first mode may include a threshold value such as a maximum total fluid volume threshold, while a second mode may not include the maximum total fluid volume threshold. As further described below, a total volume of fluid discharged may be compared to the maximum total fluid volume threshold to determine if operations of an electronic pump should be modified.

In some embodiments, a pump may be operated as a closed-loop system that does not require external human intervention or intervention from another external device. For example, a pump may be operated in an operational mode that, after being provided a target operational parameter or state, may include operations to modify its operational parameters to satisfy the target operational parameter or target state. The operational mode may execute a set of instructions to start a pump engine or increase a pump rotation speed after a pressure measurement such as an inlet pressure measurement (or mean average of inlet pressure measurements) is equal to or greater than a first pressure threshold.

In some embodiments, satisfying the first pressure threshold of the operational mode for an electronic pump may indicate that a different pump positioned upstream of the electronic pump had been activated. The operational mode may also include instructions to increase the pump rotation until the sensor measurement (or a measure of central tendency of sensor measurements) reaches a target state or is within a target range. Example target states may include a target temperature and target flow rate. For example, the operational mode may also include a second set of instructions to increase or decrease a pump speed until a measured inlet pressure is within 10% of a target value, such as a target inlet pressure. In some embodiments, the set of instructions may be operated sequentially. For example, in some embodiments, the first set of sequences may start a pump engine before the second set of instructions may be implemented. In some embodiments, the system may include a third set of instructions that include operations to shut down the engine of the electronic pump when a sensor measurement satisfies a third threshold or threshold range. For example, some embodiments may include instructions to stop the pump engine if an inlet pressure is equal to or less than a third pressure threshold.

In some embodiments, a threshold may be based on a duration. An operational mode may include a threshold that includes a sensor measurement component and a duration component. For example, an operational mode of an electronic pump may include a time-based pressure threshold that requires that a temperature measurement or pressure measurement be greater than a temperature or pressure threshold for at least one minute before determining that the time-based threshold is satisfied.

In some embodiments, one or more of the response values used to determine an operational parameter may vary based on an operational mode. For example, some embodiments may include a plurality of response magnitudes for changing an operational parameter based on sensor measurements or other operational parameters. Some embodiments may change a pump speed at a rate of 1.0 RPM per minute (e.g., changed from 10.0 RPM to 9.0 RPM in one minute) if the difference between the measured inlet pressure and the target inlet pressure is greater than 100 kilopascals (kPa), and a rate of 0.1 RPM per minute (e.g., changed from 9.1 RPM to 9.0 RPM in one minute) otherwise.

Some embodiments may use routines to determine threshold values for pumping operations of an electronic pump. For example, the electronic pump may perform operations to initially pressurize process fluid at an inlet pipe, open a valve that allows the process fluid to flow into a pump chamber, and then stop the pump to prevent process fluid from leaving the pump chamber. Some embodiments may then execute a threshold-finding routine to measure pressure values or other fluid properties (e.g., temperature, density, etc.) and determine one or more pressure thresholds usable for starting/stopping routines. For example, some embodiments may determine a pressure threshold by determining the pressure measurement at an inlet pipe when a process fluid is pressurized at the inlet pipe for 10 minutes, where the fluid pressure after 10 minutes may be set as the pressure threshold. Some embodiments may then activate a pump in response to a future pressure measurement satisfying the pressure threshold, such as by being equal to or greater than the pressure threshold. In some embodiments, the use of threshold determination routines may be advantageous by providing a method of standardizing pump behavior that is adaptable to different terrains. For example, by using a routine to determine threshold pressures for an electronic pump in a fluid distribution network, a system may overcome issues related to variations in elevation or pipe roughness that may cause each pump to have their own initial inlet pressures when fluid is not flowing through the pump. Furthermore, some embodiments may periodically use a threshold-determining routine to re-compute one or more thresholds when set in a closed-loop operational mode or another operational mode. Some embodiments may perform self-correcting calibration by re-computing thresholds to account for environmental changes that occur over the lifespan of an electronic pump or a pump network.

Use of a closed-loop operational mode may allow the continual or continuous manipulation of a set of operational parameters to achieve or maintain a target operational parameter or measurement value. Achieving or maintaining the target operational parameter may reduce the risk of cavitation, unnecessarily high pressures, or other fluid flow phenomena that may be detrimental to a pump component. Furthermore, use of a sensor-based closed-loop operational mode may provide responsive behavior that would be infeasible for a human operator due to the inability of a human operator to detect flow changes and intelligently respond within real-time operations. For example, some embodiments may detect flow changes that satisfy one or more thresholds and modify pump operations in response to the satisfaction of the threshold(s), such as less than 1 minute, less than 10 seconds, or less than 1 second.

In some embodiments, an operational mode may be pre-selected or manually selected by a user via a user interface. Various operational modes may include one or more target values or one or more operational ranges. For example, an operational mode may include instructions and values comprising instructions to discharge a process fluid having a target discharge pressure while staying within one or more operational limits (e.g., below a maximum inlet pressure and below a maximum operating temperature). In some embodiments, the operational mode may include further instructions to work in conjunction with other pumps to mix two streams of fluids in a fluid distribution network. In some embodiments, the operational mode may include additional instructions to keep sensor measurements from sensors outside of the pump at a target value or within a target range. For example, some operational modes may include a threshold water level for a water source (e.g., a water tank, a pool, a pond, etc.) and instructions to not pump water from the water tank if the water level is below the threshold water level.

In some embodiments, the process 300 may include determining whether to modify operations of the electronic pump based on the set of state representations, as indicated in block 320. In some embodiments, as discussed above, a determination may be made to modify electronic pump operations based on the set of state representations and thresholds based on instructions associated with an operating mode of the electronic pump. For example, some embodiments may determine that a threshold is satisfied and, in response, open a set of valves or otherwise reconfigure a set of values. In some embodiments, the set of valves may include a set of recirculation valves. For example, in response to a determination that a temperature measurement is less than a temperature threshold, some embodiments may configure a recirculation valve to expose a portion of fluid to a recirculation loop. Fluid may flow through the recirculation valve, be heated in a recirculation loop subsystem, and leave through a recirculation discharge stream. In some embodiments, manipulation of the recirculation valve may be used to increase or decrease the pressure of fluid entering and leaving an electronic pump.

As discussed above, various operational modes may be used, where an operational mode may include a set of operational parameters, target states, program code instructions, or the like. In some embodiments, a first operational mode may include a set of target states. The operational mode may also include or be otherwise associated with program code instructions to modify operational parameters to achieve the set of target states. The operational parameters may include various controllable parameters for an electronic pump, such as a pump rotation speed, an amount of fuel to provide a pump engine, whether a valve is open, a value correlated with the opening size of a valve, a flow rate of fluid through a heat exchanger, a flow rate of exhaust gas or preheated water through a heat exchanger, an amount of fuel to provide to a secondary heat source for a recirculation loop subsystem, or the like. For example, some embodiments may determine that a state representation, such as a temperature measurement of fluid being discharged, is less than a target temperature and, in response, modify operations based on the state representation. In some embodiments, may including a recirculation operation, detrimental effects, such as the presence of a vacuum in a pipe, may be decreased. In addition, a recirculation valve may provide a safer method of stopping a pump in the event of an internal pump pressure not satisfying a pump pressure safety threshold by helping bleed off excess pressure back into a fluid source or inlet pipe.

Some embodiments may obtain previous instructions from a wireless message that may cause an electronic pump to prevent changes in sensor measurements from affecting modifications in pump operations. In some embodiments, the previous instructions may include a set of ranges in which a sensor measurement may vary before causing the pump to change operations. For example, the previous instructions may include values representing a range of 700 kPa to 4000 kPa in which an inlet flow may vary without causing the electronic pump to modify a pump rotation speed. Alternatively, or in addition, some embodiments may obtain instructions to ignore changes in sensor measurements more or less than a threshold ratio. For example, an electronic pump may have received a set of previous instructions without an explicitly sent set of ranges in which a sensor measurement may vary, and the electronic pump may execute instructions that prevent the electronic pump from changing a flow rate until a change in inlet pressure measurement exceeds 10% of a target inlet pressure measurement.

In some embodiments, the previous instructions may include a duration threshold during which the instructions sent via the wireless message may be considered active, and after which the instructions sent via the wireless message may be overridden. For example, a set of wirelessly-transmitted values may include a value encoded as a duration threshold that is translated by a computing device of the electronic pump to be equal to one hour. In response, the electronic pump may determine operational parameters based on the wireless instructions for a duration of one hour before reverting operational parameters to values determined based on sensors of the electronic pump. Alternatively, or in addition, the electronic pump may execute instructions to ignore instructions transmitted from a wireless message or operational parameters determined based on values transmitted via a wireless message after a pre-set duration. For example, the electronic pump may store or execute pre-coded instructions to ignore wirelessly-transmitted instructions after two hours. In some embodiments, an electronic pump may maintain a set of operational parameters originally determined based on instructions sent via a wireless message after a duration threshold but update the set of operational parameters once an elapsed time exceed the duration threshold. For example, a system may receive a set of instructions having an associated duration threshold of one hour that causes an electronic pump rotor to rotate at a rate of 50 RPM. An electronic pump may execute program instructions that causes a process or the electronic pump to determine that an elapsed time of 1.01 hours exceeds the duration threshold of one hour and, in response to a sensor measurement satisfying a threshold, rotate the electronic pump rotor at a rate other than 50 RPM.

Some embodiments may determine that operations of the electronic pump should be modified in response to the detection of an anomalous state. In some embodiments, an anomalous state may include specific labels associated with physical phenomena, such as "engine misfire," "engine overheat," "pipe burst," or the like. Alternatively, or in addition, an anomalous state may include labels that indicate that a pump state or a flow state in a pipe is in an anomalous flow state without specifying a specific physical cause of the anomaly.

Some embodiments may detect anomalies based on values retrieved from a library of values. A library of values may be indexed by otherwise include a set of reference keys. Each respective reference key of the set of reference keys may be associated with a respective set of measurements, state representations based on the respective set of measurements, or thresholds based on the state representations. For example, the library of values may include a set of normalized rotation speeds that is used a set of reference keys. Each respective normalized value or bin surrounding the respective normalized values may be associated with a respective set of thresholds based on sensor measurements.

In some embodiments, a system may determine whether one or more values of a set of state representations satisfy a threshold, where the threshold may be determined based on a reference key. For example, some embodiments may recompute or otherwise re-determine a reference key based on an operational parameter such as rotation speed or a set of measurements and then retrieve a threshold from a database of thresholds indexed by reference keys based on the reference key. The reference key may have been initially calculated at an earlier timepoint based on an earlier rotation speed and earlier set of measurements. Some embodiments may then determine whether a state representation such as a temperature measurement satisfies the threshold and, in response to a determination that the state representation satisfies the threshold, modify an electronic pump operation. For example, some embodiments may determine a reference key based on a pump rotation speed and a pressure measurement provided by a first pressure sensor, retrieve a temperature threshold from a database using the reference key, and determine that a state representation provided by a second sensor satisfies a criterion based on the temperature threshold. As described elsewhere in this disclosure, the state representation may be a single measurement or may be a summary value, such as a mean average of a set of temperature measurements. For example, some embodiments may determine that a mean average of the previous 30 temperature measurements is greater than a temperature threshold. In response, some embodiments may determine that the state representation satisfies the temperature threshold. By storing reference keys based on measurements provided by a first sensor to retrieve threshold values used for comparison with measurements provided by a second sensor, some embodiments may reduce the time required to retrieve threshold values. Furthermore, storing different thresholds based on different sets of sensor measurements corresponding with different sensors may increase the adaptability of an electronic pump to detect anomalies and respond to the anomalies.

In some embodiments, a state representation or a threshold(s) to which the state representation is compared may include a summary value such as a sum, a range, a measure (s) of central tendency (e.g., mean, medians, mode), a measure(s) of dispersion (e.g. standard deviation), or the like. For example, some embodiments may retrieve a threshold from a database of thresholds indexed by reference keys, where the reference key may be calculated based on a pressure measurement provided by a pressure sensor, and where the threshold may be a mean average of a previous 355 discharge temperatures. Some embodiments may compute a state representation as equal to a mean average of a previous 15 discharge temperatures and may compare this mean average temperature to the threshold retrieved from the database of thresholds. By using a mean average or another summary value instead of relying on a single measurement to determine whether a flow is in an anomalous state or otherwise base a threshold on the measure of central tendency, the effects of sensor noise, drift, and other sources of sensor error on the operations of the process 300 may be reduced.

Some embodiments may use a duration to determine which measurements to use for determining a measure of central tendency instead of using a fixed number of previous measurements. For example, a state representation may include a mean average of the previous temperature differences over a 10-minute period and a threshold may include a mean average of the previous temperature differences over a 120-minute period. The temperature differences may include temperature differences between the discharge temperatures and inlet temperatures measured at an electronic pump. By using durations instead of measurement counts to determine which measurements to analyze, issues such as infrequent sampling, sensor noise, and other sources of sensor error may be mitigated.

In some embodiments, if the state representation is greater than a threshold, a computing system may determine that the flow is in an anomalous flow state or may cause the system to determine that the operational parameters of an electronic pump should be modified. Alternatively, or in addition, some embodiments may determine a specific category for the anomalous flow state. For example, if the state representation is 30 kPa and satisfies a threshold of 50 kPa by being less than 50 kPa, some embodiments may categorize a status of an electronic pump as being in an anomalous flow state. Some embodiments may use additional thresholds or other criteria to categorize an anomalous flow state further. For example, some embodiments may include operations to label an anomaly as a pipe burst based on a pressure difference being less than 40% of an average pressure difference. Additionally, some embodiments may categorize a flow status or other pump status based on a threshold ratio. For example, some embodiments may categorize an electronic pump status based on the state representation being greater than or equal to 80% of a threshold.

In some embodiments, a library of values may include a set of parameters in a trained neural network. For example, a computing device may obtain the measurements from sensors of an electronic pump, and, in response, categorize the flow entering the electronic pump using a neural network. The neural network may be trained and may be operated on hardware specialized for accelerating artificial intelligence (AI) operations. For example, some embodiments may include application-specific integrated circuits (ASIC) that include specialized inference-compute engines that may be optimized for low-precision computations.

In some embodiments, the library of values may include correlations or mappings between measurements, operational parameters, or combinations thereof. For example, a library of values may include a data table comprising empirically tested values correlating pump rotation speeds and discharge pressures with a flow rate. In some embodiments, the data table may be populated during a calibration test performed on the electronic pump. For example, after a calibration test, the data table may include an entry that maps the normalized rotation speed 0.5 and the normalized discharge temperature 0.25 with an effective fluid transport distance of 1.3 kilometers in a cold region. In some embodiments, the mapping of operational parameters or a first subset of measurements to one or more other measurements may be especially useful to overcome limitations in equipment or to verify the accuracy of the equipment. For example, by correlating rotation speed and temperature to an effective distance, an effective fluid transport radius for an electronic pump may be predicted for a particular region.

Some embodiments may determine that a state representation indicates non-anomalous behavior in cases that would otherwise trigger a determination that the fluid is in an anomalous flow state. For example, the system may determine that a pump is in an "idle" state and that anomalous data (e.g., a sudden pressure drop that satisfies a pressure threshold) may be ignored. In some embodiments, a determination that the pump is in an "idle" state may cause the system to stop data collection operations or otherwise prevent measurements or operational parameters to change the library of values.

Some embodiments may use a neural network to detect anomalies in an electronic pump. The neural network may include one or more types of neural networks, such as a feedforward neural network, recurrent neural network, radial basis function network, modular networks, some combination thereof, or the like. A neural network may include an input layer and a set of additional layers, where each layer may include a set of neural network nodes. For example, a neural network may include multiple additional layers, where state representations or other values may be used as inputs to compute a set of intermediate output values from a first layer. The set of intermediate output values may be used as inputs for a second layer of the neural network to produce another set of output values, which may be used as another set of intermediate output values to be consumed by another layer or as the final set of outputs of the neural network. In some embodiments, a neural network may be trained by using a pre-existing dataset to train encoder weights in a set of hidden layers, where the dataset includes training input state representations and objective values that may indicate a status of an electronic pump or a fluid flowing through the electronic pump. A status of the electronic pump may be indicated using a boolean, numeric value, categorical value, or the like. The status of the electronic pump may refer to a status of the entire electronic pump or a portion of the electronic pump (e.g., an engine failure, a coolant leak, a clog, or the like). Example status indicators may indicate that the entire pump is operating within expected parameters, that a section of pipe attached to the pump is showing anomalous behavior, that a process fluid exceeds an acceptable range of a target temperature, or the like.

During the training of the neural network, the training input may be used to produce training outputs using a loss function to determine neural network parameters or other training outputs. Loss function results based on differences between the training output and the objective values may be backpropagated, such as by using gradient descent backpropagation, to modify the parameters of the neural network over a set of training operations to better match the training output with the objective values. Furthermore, training methods other than gradient descent may be used to train a neural network, such as a global optimization method (e.g., genetic algorithms, simulated annealing, or particle swarm optimization). Once trained, the neural network may be used to reduce a set of state representations to a numeric or categorical value that may then be used to determine a status of the electronic pump, where one or more the statuses may be associated with a determination that the operational parameters should be modified. In some embodiments, determining that the operational parameters should be modified may include determining new values for the operational parameters to be modified.

In some embodiments, a feedforward neural network may be used when determining whether to modify an electronic pump operation. Example feedforward neural networks may include autoencoders, single-layer perceptrons, multi-layer perceptrons, convolutional neural networks, or the like. The neural network nodes of a feedforward neural network are acyclic and do not need to connect with neural network nodes of previous layers. The acyclic property of a feedforward neural network may increase a computation speed when calculating the output of the feedforward neural network. This speed increase may be advantageous when categorizing a pump status or responding to issues in real-time.

Some embodiments may use a recurrent neural network to categorize a pump status or determine whether to modify a pump operation. In recurrent neural networks, the output of a previous time step may be used as input when calculating an output for a current time step. For example, a recurrent neural network may use a first temperature value as an input value to determine a first output value, where the first temperature value is measured at a first time point that is 30 seconds before a second time point at which a second temperature value is measured. The recurrent neural network may then use the first output value and the second temperature value to determine a second output value. Example recurrent neural networks may include convolutional recurrent neural networks, Hopfield networks, LSTM neural networks, gated recurrent units, or the like. Various other machine-learning techniques, such as reinforcement learning and attention mechanisms, may be used to increase learning operation efficiency. For example, some embodiments may train a neural network implemented with one or more attention mechanisms that increase an attention weight associated with changes based on valve activation or heat exchanger manipulation to determine the effects of operational parameters on temperature. In some embodiments, a trained neural network may be used to provide an optimal set of operational parameters to provide a specified target discharge temperature at a target discharge pressure.

In some embodiments, a computing device may perform operations to implement one or more other machine learning methods for anomaly detection, such as reinforcement learning operations, support vector machine operations, decision tree operations, linear classifier operations (e.g., linear discriminant analysis, Naïve Bayes, logistic regression), clustering operations (e.g., centroid-based clustering, connectivity-based clustering, density-based clustering, subspace clustering, or the like), or the like. For example, a computing device of the electronic pump may receive a set of pressure and temperature measurements from sensors distributed throughout an electronic pump. The computing device may then perform operations to implement a decision tree or other machine learning operation to determine whether an electronic pump is showing signs of an anomalous state such as a state corresponding with an engine failure, a broken heat exchanger, or other equipment failures.

A library of values may include one or more library parameters used by one or more of these other learning operations. In some embodiments, a computing device may perform a plurality of classification operations. For example, a computing device may use an autoencoder to perform a first classification operation to detect a first anomalous status and use clustering to detect a second anomalous status. In some embodiments, library parameters, such as clustering parameters, anomalous status labels, or neural network parameters may be transferred to multiple computing devices throughout a wireless mesh network of the fluid distribution network. In some embodiments, the transfer may be performed as part of a transfer learning operation.

In some embodiments, anomaly properties may be identified. Some anomalies such as engine misfire, internal pipe leak, or pump overheating may be associated with one or more quantities indicating the severity of the anomaly. For example, an engine misfire may be associated with a discrepancy in a crankshaft rotational velocity by a pump engine sensor, and the pump engine sensor may be able to provide a percentage by which the crankshaft rotational velocity varies to indicate the severity of the engine misfire. Additionally, one or more temperature sensors in the engine may provide an indication of the degree of overheating for an electronic pump.

In some embodiments, a determination may be made that a connection with a server or other computing system has been lost or that an expected message (e.g., a recurring heartbeat message) not been received. Some embodiments may determine that operations of an electronic pump should be modified in response to a determination that the signal is lost. For example, some embodiments may switch from a first operational mode to a second operational mode in response to a determination that an expected signal has not been received within a time threshold, the operational modes may include any of the operational modes described in this disclosure. Switching operational modes may cause a change in a target state, a change in a threshold, a response parameter, or the like. For example, after a determination that a connection has been lost or that an expected message is not received, an electronic pump controller may switch an operational mode labeled "local operations" and update a threshold corresponding to a target temperature or target pressure to a pre-set threshold. After the threshold change, some embodiments may then modify operations of an electronic pump to satisfy criteria based on the pre-set threshold. For example, some embodiments may modify the configuration of a recirculation valve to be greater than a new minimum temperature threshold.

In some embodiments, the process 300 may include providing a signal indicating a change in status or sensor measurement of the electronic pump, as indicated in block 324. In some embodiments, the signal may include an indicator that indicates detection of the anomalous state, where the signal may be transmitted via a wireless connection. For example, the signal may be transmitted from a wireless transmitter using one or more frequencies. In some embodiments, the signal may be propagated through a wireless network, such as a LORA network, where each computing device may act as a node of the wireless network. Alternatively, or in addition, the status of the electronic pump may be propagated through a wired connection or even through a pipe system itself. For example, an electronic pump may be electrically connected to a pipe system, where the pipe system includes a conductive material such as steel, and electrical signals may be transmitted through the pipe system itself.

In some embodiments, a wireless message may be transmitted over a single electromagnetic wave. Alternatively, or in addition, the wireless message may be sent over multiple electromagnetic waves or be transmitted across a plurality of frequencies or frequency channels. Furthermore, a wireless message may include electromagnetic waves or other wireless signals transmitted at different times. For example, a wireless message may be transmitted as a first set of radio waves and a second set of radio waves, where the first set of radio waves are transmitted five milliseconds before the second set of radio waves. Similarly, a set of sensor measurements may be transmitted in a wireless message by transmitting a first subset of the sensor measurements in a first set of radio waves and then transmitting a second subset of the sensor measurements in a second set of radio waves, where the second set of radio waves are sent 50 milliseconds after the first set of radio waves are sent. In addition, the wireless message may include one or more set of geospatial coordinates indicating a pump position or a position between two pumps associated with the anomalous state.

In some embodiments, transmitting data through a wireless network may include implementing one or more data compression algorithms. For example, some embodiments may use data compression algorithms such as lossless compression algorithms or lossy compression algorithms to reduce the data consumed by an electronic pump when sending or receiving a wireless message. In some embodiments, data may be transmitted over a wireless message as a set of 16-bit integer values. For example, some embodiments may transmit data or one or more instructions by transmitting three 16-bit integers. In some embodiments, a computing device attached to the receiver of the 16-bit integer may partition one or more of the 16-bit integers into distinct values to determine a measurement of a sensor, an operational parameter of a pump, or the like. For example, the first six bits of a 16-bit integer may be used to represent 1 of 64 possible operational parameter values for a normalized RPM of a pump, and the next seven bits of the 16-bit integer may be used to represent one pressure measurement of 256 possible measurement values for a normalized pressure measurement.

In some embodiments, the process 300 may include modifying an operation of the electronic pump, as indicated in block 340. Modifying an operation of the electronic pump may include or be otherwise be based on an operational mode, the set of measurements obtained by the electronic pump, and the like. For example, in response to a determination that a fluid pressure at a source has decreased below a threshold value, a rotation speed of the pump may be decreased or entirely stopped.

As discussed above, the operational parameters of an electronic pump may be modified based on one or more target values. In some embodiments, modifying the operational parameters of the pump may include stopping an electronic pump from pumping fluid. For example, a total volume of fluid discharged by an electronic pump may be a state representation and may be compared to a maximum total fluid volume threshold. In response to the maximum total fluid volume threshold being less than or equal to the total volume of fluid discharged by the electronic pump, the system may stop a pump engine or otherwise stop a pump from discharging additional fluid. Furthermore, as discussed above, some embodiments may include the use of one or more learning operations to determine a categorical or quantitative value for a set of operational parameters of the electronic pump.

FIG. 4 is a flowchart of operations to modify an electronic pump operation based on a target state, in accordance with some embodiments. In some embodiments, the process 400 may include obtaining a target state, as indicated in block 401. As discussed elsewhere in this disclosure, a target state may be obtained from a wireless signal, a wired signal, a preset value associated with a mode of the electronic pump, or the like. For example, some embodiments may obtain a target state, such as a target temperature for a sensor or sensor type from a first operational mode, where the target temperature may represent a minimum allowable temperature value for the first operational mode. The operations described for the process 400 include updating operations to modify valves, heat exchangers, direct heating elements, or other components of an electronic pump. Some embodiments may modify electronic pump components in a specific sequence to increase the level of control over pump operations or use components that are more durable or require fewer resources to maintain. Alternatively, some embodiments may modify components of an electronic pump in a different order, such as by first modifying operations of a direct heating element described for block 424 before modifying the state of a valve as described for block 408 or by first modifying a heat exchanger operation as described for block 416 before modifying the operation of a valve as described for block 408.

In some embodiments, the process 400 may include determining whether a sensor measurement satisfies a set of criteria based on the target state, as indicated in block 404. The set of criteria may be based on a target state, such as a target temperature or target pressure, by using the target state as a threshold value or determining threshold values based on the target state. The set of criteria may include criterion such as a requirement that the target temperature is less than a maximum value, greater than a minimum value, within a range of values, or equal to a single value. For example, if the target state is a target temperature representing a minimum allowable temperature value and a temperature measurement acquired by a sensor is greater than the minimum allowable temperature value, a determination may be made that the temperature measurement of the sensor satisfies a set of criteria based on the target state. Alternatively, if the temperature measurement is less than the minimum allowable temperature value, a determination may be made that the temperature measurement of the sensor does not satisfy the set of criteria based on the target state. Some embodiments may use of one or more trained neural networks or other trained learning systems to determine whether a sensor measurement or set of sensor measurements satisfies the set of criteria. If a determination is made that the sensor measurement of the sensor satisfies the set of criteria, operations of the process 400 may proceed to block 408. Otherwise, operations of the process 400 may end operations of the process 400.

In some embodiments, the process 400 may include modifying a set of valves, as indicated in block 408. In some embodiments modifying the set of valves may include opening, closing, or otherwise updating the configuration of a set of valves that control fluid flow in an electronic pump. For example, some embodiments may control a valve to divert fluid to a recirculation loop. As discussed above, a recirculation loop passing in the proximity of an engine may cool the engine and heat the fluid flowing through the recirculation loop. Alternatively, a recirculation loop may include cooling elements such that passing a process fluid through the recirculation loop may cool the recirculation fluid. In some embodiments, a valve being opened may have only open or closed states. Alternatively, a valve may have a plurality of states corresponding to different opening sizes. Some embodiments may modify a fluid temperature, fluid pressure, fluid flow rate, or the like by modifying a valve from a first state to a second state, which may change a sensor measurement.

In some embodiments, the process 400 may include determining whether a sensor measurement acquired after modifying the set of valves satisfies the set of criteria, as indicated in block 412. In some embodiments, a first modification of an operational parameter, such as a modifying the state of a set of valves, may be insufficient to causing a state representation such as a temperature measurement from satisfying the set of criteria. In response, some embodiments may modify a second operational parameter, as further described below. Operations to determine whether the temperature measurement of the sensor acquired after opening the valve satisfies the target temperature for the sensor may use methods similar to those described for block 404. If a determination is made that the set of sensor measurements satisfies the set of criteria, operations of the process 400 may proceed to block 416. Otherwise, operations of the process 400 may end operations of the process 400.

In some embodiments, the process 400 may include modifying the operations of one or more heat exchangers in the recirculation loop, as indicated in block 416. As discussed above, a heat exchanger of a recirculation loop may heat a process fluid flowing through the recirculation loop. In some embodiments, parameters such as the flow rate of heated material flowing through the heat exchanger in a countercurrent direction to a process fluid may be an operational parameter. Increasing or decreasing the flow rate of heated material flowing through the heat exchanger may change the temperature of the process fluid. For example, increasing the flow rate of exhaust gas through an exhaust gas heat exchanger of an electronic pump may increase the temperature of a process fluid discharged by the electronic pump.

In some embodiments, the process 400 may include determining whether a sensor measurement acquired after modifying the operations of the heat exchanger satisfies the set of criteria, as indicated in block 420. In some embodiments, a first set of modifications of a set of operational parameters, such as a modifying the state of a set of valves and the operations of a heat exchanger, may be insufficient to causing a state representation such as a temperature measurement from satisfying the set of criteria. Operations to determine whether a sensor measurement acquired after modifying the operations of the heat exchanger satisfies the set of criteria may use methods similar to those described for block 404. If a determination is made that the sensor measurement acquired after modifying the operations of the heat exchanger satisfies the set of criteria, operations of the process 400 may proceed to block 424. Otherwise, operations of the process 400 may end operations of the process 400.

In some embodiments, the process 400 may include modifying an operational parameter associated with a direct heating element, as indicated in block 424. Modifying an operational parameter associated with a direct heating element may include changing an amount of energy provided to the direct heating element. For example, some embodiments may increase an amount of fuel provided to a flame of the direct heating element, which may increase the amount of heat transferred to a process fluid.

In some embodiments, the process 400 may include determining whether a sensor measurement acquired after modifying the operations of the direct heating element satisfies the set of criteria, as indicated in block 428. For example, some embodiments may determine whether a temperature measurement acquired after modifying a direct heating element satisfies a criterion that the temperature be within a range of a target temperature. Operations to determine whether the temperature measurement of the sensor acquired after opening the valve satisfies the target temperature for the sensor may use methods similar to those described for block 404. If a determination is made that the sensor measurement acquired after modifying the operations of the direct heating element satisfies the set of criteria, operations of the process 400 may proceed to block 440. Otherwise, operations of the process 400 may end operations of the process 400.

In some embodiments, the process 400 may include performing additional modifications to the operational parameters of an electric pump to satisfy a target temperature, as indicated in block 440. In some embodiments, various other components of an electronic pump may be electronically actuated. For example, some embodiments may modify the operations of mixing components of an electronic pump, changing a power source, or otherwise reconfiguring an electronic pump.

In some embodiments, one or more operations of the process 400 may be iteratively performed until the set of criteria based on the target state(s) is satisfied. In some embodiments, the operational parameters described in the process 400 may be quantified, and a system of functions may be set up to analyze the relationships between operational parameters and sensor measurements. In some embodiments, the analysis may be used to produce an optimal set of operational parameters to satisfy the set of criteria. In some embodiments, determining an optimal set of operational parameters may include one or more learning operations described above that uses an initial set of measurements and operational states as inputs and provides, as an output, a set of operational parameters predicted by a machine learning system to satisfy the set of criteria.

Figure 5:
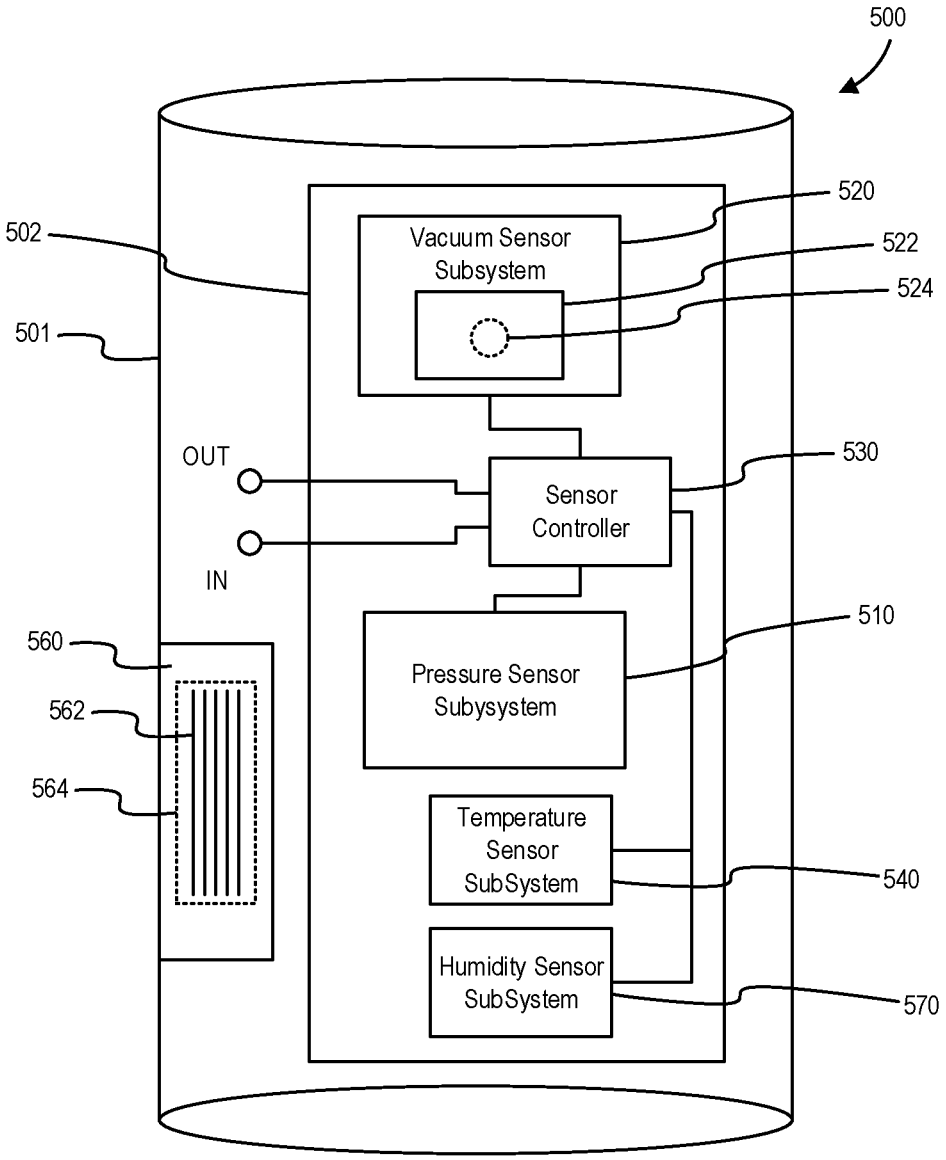
FIG. 5 is a schematic diagram of a multi-sensing device, in accordance with some embodiments.

FIG. 5 is a schematic diagram of a multi-sensing device, in accordance with some embodiments. In some embodiments, a multi-sensing device 500 may include a protective enclosure 501 surrounding a base 502. A pressure sensor subsystem 510 may be mounted on the base 502. A vacuum sensor subsystem 520 may also be mounted on the base 502. As discussed above, the vacuum sensor subsystem may include a vacuum sensor protector 522 to shield a vacuum sensor 524. In some embodiments, the vacuum sensor protector 522 may include a plate, screen, pressure gauge, or another physical barrier to shield the vacuum sensor 524 from a surrounding atmosphere.

The multi-sensing device 500 may include a sensor controller 530 that is also mounted on the base 502. In some embodiments, the sensor controller 530 may activate or deactivate the vacuum sensor subsystem 520 based on a pressure measurement from the pressure sensor subsystem 510. For example, the sensor controller 530 may activate the vacuum sensor subsystem 520 in response to the pressure sensor subsystem 510 providing a pressure measurement less than a pressure threshold. In some embodiments, activating the vacuum sensor subsystem may include changing the state of the vacuum sensor protector 522. Alternatively, or in addition, activating the vacuum sensor subsystem 520 may include powering one or more components of the vacuum sensor 524. For example, the vacuum sensor 524 may include a variable capacitance device or piezoresistive device to provide pressure measurements. Capacitance changes in a variable capacitance device or resistivity changes in a piezoresistive device may be correlated with a pressure measurement from the vacuum sensor 524.

In some embodiments, the multi-sensing device 500 may include a temperature sensor subsystem 540. The temperature sensor subsystem 540 may include one or more temperature sensors to measure a temperature and report the temperature from the multi-sensing device 500. In some embodiments, the temperature sensor may output temperature measurements to the sensor controller 530, which may then apply one or more pre-processing steps to the temperature measurements. For example, the sensor controller 530 may apply a sensor noise mitigation operation to reduce the effect of sensor noise on the temperature measurements. In some embodiments, the sensor controller 530 may perform operations to report a set of output values indicating a pressure value, a temperature value, and a measurement time associated with both the pressure value and the temperature value. Alternatively, or in addition, the sensor controller 530 may perform operations to report a pressure measurement, a first measurement time at which the pressure measurement was obtained, a temperature measurement, and a second measurement time at which the temperature measurement was obtained, where the first measurement time and the second measurement time are independent of each other.

In some embodiments, the multi-sensing device 500 may include a vent system 560 that includes a set of vents 562 and a filter 564. The set of vents 562 may permit air to flow through the protective enclosure 501, and the filter 564 may prevent moisture from passing from the exterior of the protective enclosure 501 to the interior of the protective enclosure 501. The filter 564 may include a set of moisture-blocking materials, such as fabrics, polymers, or desiccants. In some embodiments, the multi-sensing device 500 may include a humidity sensor 570 to monitor a humidity level. In some embodiments, humidity changes may affect pressure measurements, and detected humidity changes reported by the humidity sensor 570 may be used to adjust a reported pressure or temperature reading. Alternatively, or in addition, a measured humidity may be compared to a humidity threshold. If the measured humidity exceeds the humidity threshold, the multi-sensing device 500 may send a message indicating that the humidity threshold is exceeded. In some embodiments, the system may flag pressure, temperature, or other measurements as inaccurate if the data is associated with a message indicating that the humidity threshold is exceeded.

In some embodiments, as discussed above, a mesh network may communicate the propagation of a pressure wave. In some embodiments, the vacuum sensor subsystem 520 may be pre-emptively deactivated even if a reported pressure is less than a pressure threshold in response to instructions from a device of the mesh network. For example, a first device of a mesh network may detect the existence of a pressure spike traveling through the pipe network towards the multi-sensing device 500. In response, a computing device may transmit instructions to the sensor controller 530 to deactivate the vacuum sensor subsystem 520 or otherwise protect the vacuum sensor 524. By pre-emptively deactivating the vacuum sensor subsystem 520 or another portion of the multi-sensing device 500, some embodiments may protect the deactivated portions or reduce noise in data provided by the multi-sensing device 500.

Figure 6:
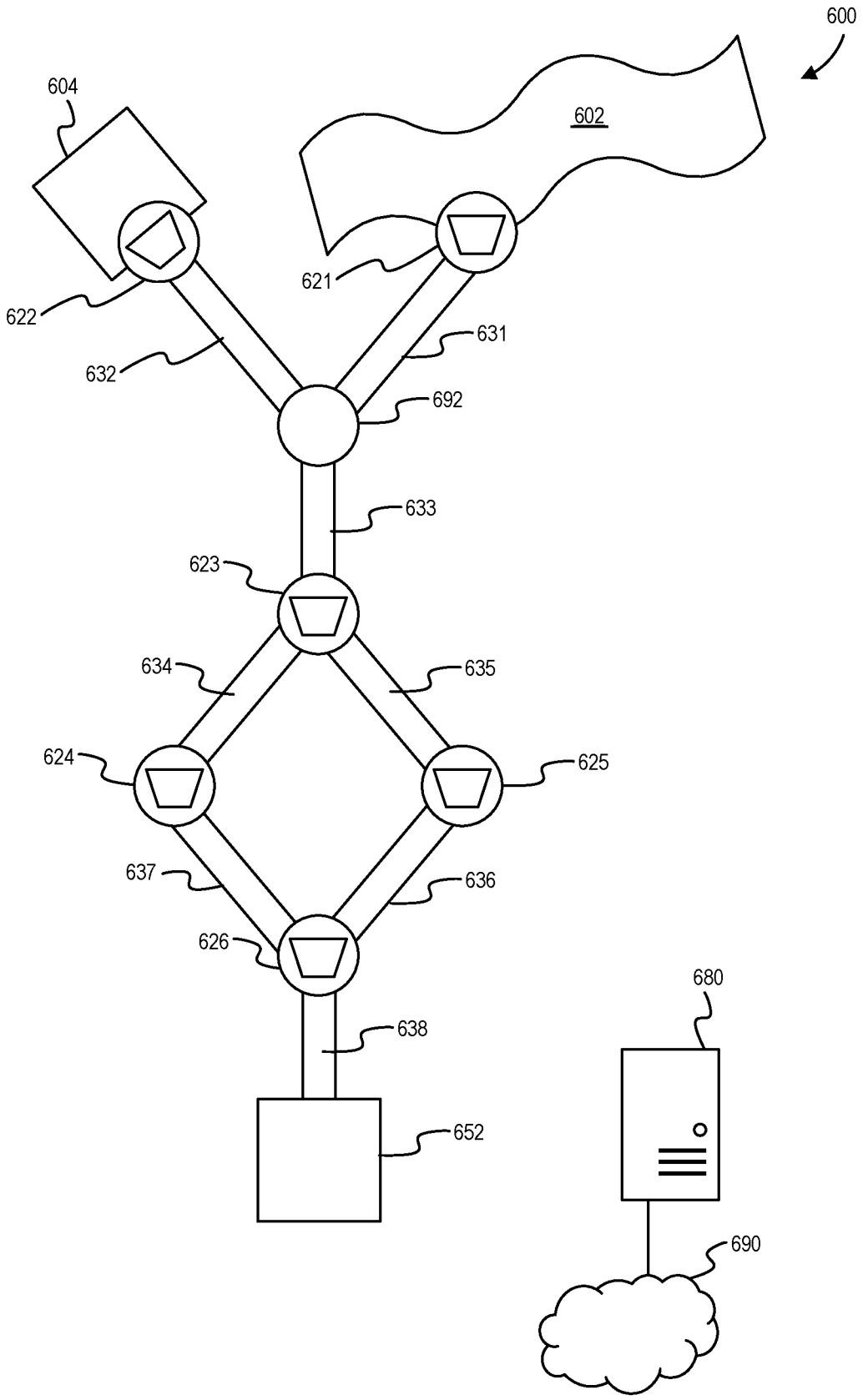
FIG. 6 is a diagram depicting a set of electronic pumps forming a fluid distribution network, in accordance with some embodiments.

FIG. 6 is a diagram depicting a set of electronic pumps forming a fluid distribution network, in accordance with some embodiments. The fluid distribution network 600 includes electronic pumps 621-626, pipes 631-638, and a server 680 in connection with a cloud system 690. Some embodiments of fluid distribution networks may be described or modeled as a network of pipes, a network of pumps, a network of channels, or the like. One or more of the electronic pumps 621-626 may be or otherwise include the electronic pump 100. One or more of the electronic pumps 621-626 may include a computer system to perform one or more of the operations described above. In some embodiments, one or more of the electronic pumps 621-626 may include wireless communication devices with mesh capabilities. Example wireless communication devices may include long-range radio mesh communication systems, wireless signal transmitters and receivers, satellite communication systems, Bluetooth/NFC communication systems, or the like. The wireless communication devices may be used to allow communication between each of the electronic pumps 621-626 with at least one of the other of the electronic pumps 621-626 and may be referred to as a "node" of a mesh network. Alternatively, or in addition, the wireless communication devices may be used to allow communication between one or more of the electronic pumps 621-626 and the server 680 or the cloud system 690, where the server 680 or the cloud system 690 may perform one or more operations described in this disclosure. It should be understood that a pump that is described as part of the mesh network includes a wireless communication device that is part of the mesh network. Similarly, transmitting data to and from a pump may be understood as transmitting data to and from a computing device of the pump via a wireless communication device, wherein the computing device may include the wireless communication device.

In some embodiments, the wireless communication devices of the electronic pumps may operate as part of the mesh network, such as a LORA network or another LPWAN. Using a sub-gigahertz frequency network such as a LORA network allow for large distances (e.g., 6 kilometer or greater, 60 kilometers or greater, etc.) to be covered by the mesh network. In addition, some embodiments may use a LORA or other LPWAN system to determine the position of one or more electronic pumps or other electronic devices in the network.

In some embodiments, a pump of the fluid distribution network 600 may communicate with one or more electronic devices such as digital sensors using various I/O equipment, such as a ModBus RS-485 serial bus or RS-632 bus, either which may be configured to support the ModBus RTU 6 protocol. In some embodiments, one or more of the computer systems of the set of electronic pumps 621-626 may operate a webserver for hosting intranet sites. For example, a computer system of the first electronic pump 621 may be used to collect data from each sensors of each of the electronic pumps 621-626. In some embodiments, one of the computing devices of the electronic pumps 621-626 may serve as a leader node in a mesh network and may provide or receive information from other electronic pumps. For example, a computing device of the first electronic pump 621 may serve as a leader node and may transmit values representing indicating statuses or instructions such as "pumping has started," "match target flow rate to 60 liters per second," or "shut down."

During an operation of the fluid distribution network 600, one or more of the electronic pumps 621-626 may be used to extract a fluid from the first fluid source 602 or the second fluid source 604 and transport the fluid through one or more pipes of the pipes 631-638 to the fluid destination 652. As shown in in the fluid distribution network 600, fluid flow may be split. For example, the third electronic pump 623 is shown to split the fluid flow from the pipe 632 into a first flow through the pipe 633 and a second flow through the pipe 634. In some embodiments, operations of the third electronic pump 623 may be changed to change a flow rate through one of a set of discharge pipes of the third electronic pump 623 without changing a flow through any other discharge pipes of the third electronic pump 623.

In some embodiments, fluid flow may be re-combined in various flow states, such as laminar flow or turbulent flow. In some embodiments, fluid flow may be combined from two different types fluids to mix the two different types of fluid. For example, a first fluid from the first fluid source 602 and a second fluid from the second fluid source 604 may be combined at the fluid network position 692. As further described below, some embodiments may change the operations of either or both of the first electronic pump 621 or the second electronic pump 622 in response to measurements obtained from sensors of at least one of the electronic pumps 621-623. For example, the third electronic pump 623 may include a measurement correlated with the mixing of water from the first fluid source 602 and solvent fluid from the second fluid source 604, and, in response to this measurement being outside of a target mixing window, increase the fluid flow from the first fluid source 602 by increasing a pumping rate of the first electronic pump 621.

Computer System

Figure 7:
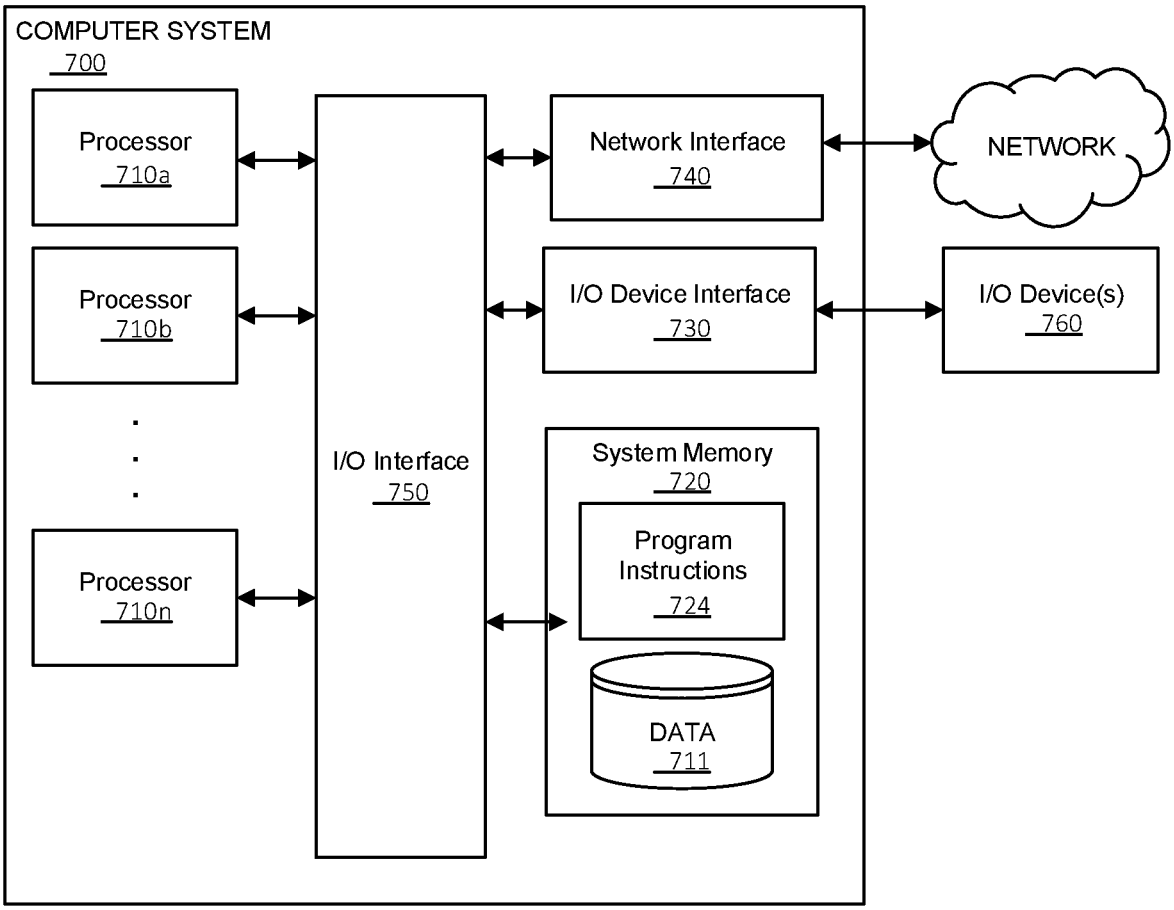
FIG. 7 shows an example of a computing device by which the present techniques may be implemented, in accordance with some embodiments.

FIG. 7 shows an example of a computing device by which the present techniques may be implemented, in accordance with some embodiments. FIG. 7 shows an exemplary computer system 700 by which the present techniques may be implemented in accordance with some embodiments. Various portions of systems and methods described herein, may include or be executed on one or more computer systems similar to computer system 700. Further, processes and modules described herein may be executed by one or more processing systems similar to that of computer system 700.

Computer system 700 may include one or more processors (e.g., processors 710*a*-710*n*) coupled to system memory 720, an input/output I/O device interface 730, and a network interface 740 via an input/output (I/O) interface 750. A processor may include a single processor or a plurality of processors (e.g., distributed processors). A processor may be any suitable processor capable of executing or otherwise performing instructions. A processor may include a central processing unit (CPU) that carries out program instructions to perform the arithmetical, logical, and input/output operations of computer system 700. A processor may execute code (e.g., processor firmware, a protocol stack, a database management system, an operating system, or a combination thereof) that creates an execution environment for program instructions. A processor may include a programmable processor. A processor may include general or special purpose microprocessors. A processor may receive instructions and data from a memory (e.g., system memory 720). Computer system 700 may be a uni-processor system including one processor (e.g., processor 710*a*), or a multi-processor system including any number of suitable processors (e.g., 710*a*-710*n*). Multiple processors may be employed to provide for parallel or sequential execution of one or more portions of the techniques described herein. Processes, such as logic flows, described herein may be performed by one or more programmable processors executing one or more computer programs to perform functions by operating on input data and generating corresponding output. Processes described herein may be performed by, and apparatus can also be implemented as, special purpose logic circuitry, e.g., a vision processing unit (VPU), a neuromorphic complementary metal-oxide-semiconductor (CMOS) chip, an FPGA (field programmable gate array), a PGA (programmable gate array), or an ASIC (application specific integrated circuit) such as a tensor processing unit (TPU). Computer system 700 may include a plurality of computing devices (e.g., distributed computer systems) to implement various processing functions.

I/O device interface 730 may provide an interface for connection of one or more I/O devices 760 to computer system 700. I/O devices may include devices that receive input (e.g., from a user) or output information (e.g., to a user). I/O devices 760 may include, for example, graphical user interface presented on displays (e.g., a cathode ray tube (CRT) or liquid crystal display (LCD) monitor), pointing devices (e.g., a computer mouse or trackball), keyboards, keypads, touchpads, scanning devices, voice recognition devices, gesture recognition devices, printers, audio speakers, microphones, cameras, or the like. I/O devices 760 may be connected to computer system 700 through a wired or wireless connection. I/O devices 760 may be connected to computer system 700 from a remote location. I/O devices 760 located on remote computer system, for example, may be connected to computer system 700 via a network and network interface 740.

Network interface 740 may include a network adapter that provides for connection of computer system 700 to a network. Network interface 740 may may facilitate data exchange between computer system 700 and other devices connected to the network. Network interface 740 may support wired or wireless communication. The network may include an electronic communication network, such as the Internet, a local area network (LAN), a wide area network (WAN), a cellular communications network, or the like.

System memory 720 may be configured to store program instructions 724 or data 711. Program instructions 724 may be executable by a processor (e.g., one or more of processors 710*a*-710*n*) to implement one or more embodiments of the present techniques. Program instructions 724 may include modules of computer program instructions for implementing one or more techniques described herein with regard to various processing modules. Program instructions may include a computer program (which in certain forms is known as a program, software, software application, script, or code). A computer program may be written in a programming language, including compiled or interpreted languages, or declarative or procedural languages. A computer program may include a unit suitable for use in a computing environment, including as a stand-alone program, a module, a component, or a subroutine. A computer program may or may not correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one or more computer processors located locally at one site or distributed across multiple remote sites and interconnected by a communication network.

System memory 720 may include a tangible program carrier having program instructions stored thereon. A tangible program carrier may include a non-transitory computer readable storage medium. A non-transitory computer readable storage medium may include a machine readable storage device, a machine readable storage substrate, a memory device, or any combination thereof. Non-transitory computer readable storage medium may include non-volatile memory (e.g., flash memory, ROM, PROM, EPROM, EEPROM memory), volatile memory (e.g., random access memory (RAM), static random access memory (SRAM), synchronous dynamic RAM (SDRAM)), bulk storage memory (e.g., CD-ROM and/or DVD-ROM, hard-drives), or the like. System memory 720 may include a non-transitory computer readable storage medium that may have program instructions stored thereon that are executable by a computer processor (e.g., one or more of processors 710*a*-710*n*) to cause the subject matter and the functional operations described herein. A memory (e.g., system memory 720) may include a single memory device and/or a plurality of memory devices (e.g., distributed memory devices). Instructions or other program code to provide the functionality described herein may be stored on a tangible, non-transitory computer readable media. In some cases, the entire set of instructions may be stored concurrently on the media, or in some cases, different parts of the instructions may be stored on the same media at different times.

I/O interface 750 may be configured to coordinate I/O traffic between processors 710*a*-710*n*, system memory 720, network interface 740, I/O devices 760, and/or other peripheral devices. I/O interface 750 may perform protocol, timing, or other data transformations to convert data signals from one component (e.g., system memory 720) into a format suitable for use by another component (e.g., processors 710*a*-710*n*). I/O interface 750 may include support for devices attached through various types of peripheral buses, such as a variant of the Peripheral Component Interconnect (PCI) bus standard or the Universal Serial Bus (USB) standard.

Embodiments of the techniques described herein may be implemented using a single instance of computer system 700 or multiple computer systems 700 configured to host different portions or instances of embodiments. Multiple computer systems 700 may provide for parallel or sequential processing/execution of one or more portions of the techniques described herein.

Those skilled in the art will appreciate that computer system 700 is merely illustrative and is not intended to limit the scope of the techniques described herein. Computer system 700 may include any combination of devices or software that may perform or otherwise provide for the performance of the techniques described herein. For example, computer system 700 may include or be a combination of a cloud-computer system, a data center, a server rack, a server, a virtual server, a desktop computer, a laptop computer, a tablet computer, a server device, a client device, a mobile telephone, a personal digital assistant (PDA), a mobile audio or video player, a game console, a vehicle-mounted computer, or a Global Positioning System (GPS), or the like. Computer system 700 may also be connected to other devices that are not illustrated, or may operate as a stand-alone system. In addition, the functionality provided by the illustrated components may in some embodiments be combined in fewer components or distributed in additional components. Similarly, in some embodiments, the functionality of some of the illustrated components may not be provided or other additional functionality may be available.

Those skilled in the art will also appreciate that while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 1000 may be transmitted to computer system 1000 via transmission media or signals such as electrical, electromagnetic, or digital signals, sent via a communication medium such as a network or a wireless link. Various embodiments may further include receiving, sending, or storing instructions or data implemented in accordance with the foregoing description upon a computer-accessible medium. Accordingly, the present techniques may be practiced with other computer system configurations.

In block diagrams, illustrated components are depicted as discrete functional blocks, but embodiments are not limited to systems in which the functionality described herein is organized as illustrated. The functionality provided by each of the components may be provided by software or hardware modules that are differently organized than is presently depicted, for example such software or hardware may be intermingled, conjoined, replicated, broken up, distributed (e.g., within a data center or geographically), or otherwise differently organized. The functionality described herein may be provided by one or more processors of one or more computers executing code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information sent over networks, in which case, to the extent information (e.g., content) is said to be supplied or otherwise provided, the information may provided by sending instructions to retrieve that information from a content delivery network.

The reader should appreciate that the present application describes several independently useful techniques. Rather than separating those techniques into multiple isolated patent applications, applicants have grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Similarly, reference to "a computer system" performing step A and "the computer system" performing step B can include the same computing device within the computer system performing both steps or different computing devices within the computer system performing steps A and B. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation. As is the case in ordinary usage in the field, data structures and formats described with reference to uses salient to a human need not be presented in a human-intelligible format to constitute the described data structure or format, e.g., text need not be rendered or even encoded in Unicode or ASCII to constitute text; images, maps, and data-visualizations need not be displayed or decoded to constitute images, maps, and data-visualizations, respectively; speech, music, and other audio need not be emitted through a speaker or decoded to constitute speech, music, or other audio, respectively. Computer implemented instructions, commands, and the like are not limited to executable code and can be implemented in the form of data that causes functionality to be invoked, e.g., in the form of arguments of a function or API call.

In this patent, certain U.S. patents, U.S. patent applications, or other materials (e.g., articles) have been incorporated by reference. The text of such U.S. patents, U.S. patent applications, and other materials is, however, only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

The present techniques will be better understood with reference to the following enumerated embodiments:

1. A tangible, non-transitory, machine-readable medium storing instructions that when executed by one or more processors effectuate operations comprising: obtaining, with a computer system, a first set of measurements output by a first sensor of an electronic pump operating at an operational parameter, wherein the electronic pump comprises a recirculation valve that diverts fluid into a recirculation loop comprising a set of heat exchangers; determining, with the computer system, a state value based on the first set of measurements using a function that comprises a binning method; determining, with the computer system, a reference key based on the state value and the operational parameter in a data structure stored in a local memory of the electronic pump; obtaining, with the computer system, a second measurement using a second sensor positioned separately from the first sensor; determining, with the computer system, a threshold based on the second measurement; storing, with the computer system, the threshold in the data structure in association with the reference key; obtaining, with the computer system, a second set of measurements, wherein the second set of measurements includes a third measurement acquired by the first sensor and a fourth measurement acquired by the second sensor; determining, with the computer system, the reference key based on the third measurement using the function; selecting, with the computer system, the threshold by using the reference key when referencing the data structure; determining, with the computer system, whether the fourth measurement satisfies a set of criteria based on the threshold; and modifying, with the computer system, an operation of the electronic pump based on the fourth measurement satisfying the set of criteria.

2. The machine-readable medium of embodiment 1, wherein the first sensor measures a temperature of the fluid as the fluid is flowing into the electronic pump.

3. The machine-readable medium of embodiments 1 to 2, wherein the reference key comprises the state value and the operational parameter.

4. The machine-readable medium of embodiments 1 to 3, wherein binning the first set of measurements comprises determining that each respective measurement of the first set of measurements is greater than a second threshold and less than a third threshold, wherein the second and third thresholds are associated with the function.

5. The machine-readable medium of embodiments 1 to 4, wherein modifying the operational parameter of the electronic pump comprises modifying a configuration of the recirculation valve to change a volumetric flow rate of fluid flowing through the recirculation loop.

6. The machine-readable medium of embodiments 1 to 5, wherein modifying the operational parameter of the electronic pump comprises changing a fluid flow rate through a heat exchanger of the set of heat exchangers.

7. A method comprising: obtaining, with a computer system, a first measurement output by a first sensor of an electronic pump operating at an operational parameter; determining, with the computer system, a value based on the first measurement; determining, with the computer system, a reference key based on the value and the operational parameter in a data structure stored in a local memory of the electronic pump; obtaining, with the computer system, a second measurement using a second sensor positioned separately from the first sensor; determining, with the computer system, a threshold based on the second measurement; storing, with the computer system, the threshold in the data structure in association with the reference key; obtaining, with the computer system, a third measurement acquired by the first sensor and a fourth measurement acquired by the second sensor; recomputing, with the computer system, the reference key based on the third measurement; selecting, with the computer system, the threshold based on the reference key; determining, with the computer system, whether the fourth measurement satisfies a set of criteria based on the threshold; and modifying, with the computer system, an operation of the electronic pump based on the fourth measurement.

8. The method of embodiment 7, wherein modifying the operation of the electronic pump comprises changing a configuration of a valve of the electronic pump, the method further comprising: obtaining a fifth measurement after the valve configuration is changed; determining whether the fifth measurement satisfies the set of criteria; and in response to a determination that the fifth measurement satisfies the set of criteria, changing a flow rate of a heat exchanger of the electronic pump.

9. The method of embodiments 7 to 8, wherein the threshold is a first threshold, the method further comprising: determining whether an expected signal is received; in response to a determination that an expected signal is not received, selecting a second threshold; determining whether a fifth measurement satisfies a second set of criteria based on the second threshold; and modifying the operation of the electronic pump based on the fifth measurement.

10. The method of embodiments 7 to 9, further comprising: determining whether the operational parameter satisfies an operational parameter threshold; and stopping a collection of measurement data from the first sensor in response to a determination that the operational parameter satisfies the operational parameter threshold.

11. The method of embodiments 7 to 10, wherein determining the value comprises determining a measure of central tendency based on a first set of measurements comprising the first measurement.

12. The method of embodiments 7 to 11, wherein obtaining the first measurement comprises: determining a sum of a first set of measurements, wherein the first set of measurements is collected by the first sensor and comprises the first measurement; storing the sum of the first set of measurements in a memory of the electronic pump; and deleting at least one measurement of the first set of measurements from the electronic pump.

13. The method of embodiments 7 to 12, wherein the value is a first value, wherein modifying the operational parameter comprises: obtaining a wireless signal comprising a second value encoded as a target state or a set of overriding instructions; and updating the operational parameter of the electronic pump based on the second value.

14. The method of embodiments 7 to 13, wherein modifying the operational parameter further comprises: determining whether an elapsed time exceeds a duration threshold associated with a wireless signal; and modifying, with the computer system, the operational parameter of the electronic pump based on a determination that the elapsed time exceeded the duration threshold associated with the wireless signal.

15. The method of embodiments 7 to 14, wherein the electronic pump is a first electronic pump, the method further comprising: determining a summary value based on a set of measurements provided by the first sensor, wherein the summary value comprises a measure of central tendency; and sending the summary value via a wireless network to a second electronic pump.

16. The method of embodiment 15, wherein the value is a first value, and wherein determining the summary value further comprises: obtaining a second value from a third electronic pump via the wireless network; and wherein determining the summary value comprises determining the summary value based on the second value and the set of measurements.

17. The method of embodiments 15 to 16, further comprising steps to determining the reference key.

18. The method of embodiments 7 to 17, further comprising steps to determining whether the fourth measurement satisfies a set of criteria.

19. An electronic pump comprising: a housing; a pipe within the housing; a first sensor within the pipe; a pump rotor to move fluid through the pipe; a pump engine attached to the pump rotor to move the pump rotor; and a computing device comprising one or more processors and memory storing instructions that when executed by the processors cause the processors to effectuate operations: obtaining a first measurement output by the sensor while the electronic pump operates at an operational parameter; determining a first value based on the first measurement; determining a reference key based on the first value and the operational parameter in a data structure stored in a local memory of the electronic pump; obtaining a second measurement using a second sensor positioned separately from the first sensor; determining a threshold based on the second measurement; storing the threshold in the data structure in association with the reference key; obtaining, with a computer system, a third measurement acquired by the first sensor and a fourth measurement acquired by the second sensor; recomputing, with the computer system, the reference key based on the third measurement; selecting, with the computer system, the threshold based on the reference key; determining whether the fourth measurement satisfies a set of criteria based on the threshold; and modifying an operation of the electronic pump based on the fourth measurement satisfying the set of criteria.

20. The electronic pump of embodiment 19, wherein: the first measurement is a pressure measurement; the sensor comprises a multi-sensor device, the multi-sensor device comprising: a low-pressure sensor, wherein the low-pressure sensor is capable of measuring pressures less than 100,000 kilopascals; and a barrier that shields the low-pressure sensor from a surrounding atmosphere; and the operations further comprise: determining whether the pressure measurement is greater than a pressure threshold; and configure the barrier into a closed state to shield the low-pressure sensor from the surrounding atmosphere based on a determination that the pressure measurement is greater than the pressure threshold.

What is claimed is:

1. A tangible, non-transitory, machine-readable medium storing instructions that when executed by one or more processors effectuate operations comprising:

obtaining, with a computer system, a first set of measurements output by a first sensor of an electronic pump operating at an operational parameter, wherein the electronic pump comprises a recirculation valve that diverts fluid into a recirculation loop comprising a set of heat exchangers;

determining, with the computer system, a state value based on the first set of measurements using a function that comprises a binning method;

determining, with the computer system, a reference key based on the state value and the operational parameter in a data structure stored in a local memory of the electronic pump;

obtaining, with the computer system, a second measurement using a second sensor positioned separately from the first sensor;

determining, with the computer system, a threshold based on the second measurement;

storing, with the computer system, the threshold in the data structure in association with the reference key;

obtaining, with the computer system, a second set of measurements, wherein the second set of measurements includes a third measurement acquired by the first sensor and a fourth measurement acquired by the second sensor;

determining, with the computer system, the reference key based on the third measurement using the function;

selecting, with the computer system, the threshold by using the reference key when referencing the data structure;

determining, with the computer system, whether the fourth measurement satisfies a set of criteria based on the threshold; and modifying, with the computer system, an operation of the electronic pump based on the fourth measurement satisfying the set of criteria.

2. The machine-readable medium of claim 1, wherein the first sensor measures a temperature of the fluid as the fluid is flowing into the electronic pump.

3. The machine-readable medium of claim 1, wherein the reference key comprises the state value and the operational parameter.

4. The machine-readable medium of claim 1, wherein binning the first set of measurements comprises determining that each respective measurement of the first set of measurements is greater than a second threshold and less than a third threshold, wherein the second and third thresholds are associated with the function.

5. The machine-readable medium of claim 1, wherein modifying the operational parameter of the electronic pump comprises modifying a configuration of the recirculation valve to change a volumetric flow rate of fluid flowing through the recirculation loop.

6. The machine-readable medium of claim 1, wherein modifying the operational parameter of the electronic pump comprises changing a fluid flow rate through a heat exchanger of the set of heat exchangers.

7. A method comprising:

obtaining, with a computer system, a first measurement output by a first sensor of an electronic pump operating at an operational parameter;

determining, with the computer system, a value based on the first measurement;

determining, with the computer system, a reference key based on the value and the operational parameter in a data structure stored in a local memory of the electronic pump;

obtaining, with the computer system, a second measurement using a second sensor positioned separately from the first sensor;

determining, with the computer system, a threshold based on the second measurement;

storing, with the computer system, the threshold in the data structure in association with the reference key;

obtaining, with the computer system, a third measurement acquired by the first sensor and a fourth measurement acquired by the second sensor;

recomputing, with the computer system, the reference key based on the third measurement;

selecting, with the computer system, the threshold based on the reference key;

determining, with the computer system, whether the fourth measurement satisfies a set of criteria based on the threshold; and modifying, with the computer system, an operation of the electronic pump based on the fourth measurement.

8. The method of claim 7, wherein modifying the operation of the electronic pump comprises changing a configuration of a valve of the electronic pump, the method further comprising:

obtaining a fifth measurement after the valve configuration is changed;

determining whether the fifth measurement satisfies the set of criteria; and in response to a determination that the fifth measurement satisfies the set of criteria, changing a flow rate of a heat exchanger of the electronic pump.

9. The method of claim 7, wherein the threshold is a first threshold, the method further comprising:

determining whether an expected signal is received;

in response to a determination that an expected signal is not received, selecting a second threshold;

determining whether a fifth measurement satisfies a second set of criteria based on the second threshold; and modifying the operation of the electronic pump based on the fifth measurement.

10. The method of claim 7, further comprising:

determining whether the operational parameter satisfies an operational parameter threshold; and stopping a collection of measurement data from the first sensor in response to a determination that the operational parameter satisfies the operational parameter threshold.

11. The method of claim 7, wherein determining the value comprises determining a measure of central tendency based on a first set of measurements comprising the first measurement.

12. The method of claim 7, wherein obtaining the first measurement comprises:

determining a sum of a first set of measurements, wherein the first set of measurements is collected by the first sensor and comprises the first measurement;

storing the sum of the first set of measurements in a memory of the electronic pump; and deleting at least one measurement of the first set of measurements from the electronic pump.

13. The method of claim 7, wherein the value is a first value, wherein modifying the operational parameter comprises:

obtaining a wireless signal comprising a second value encoded as a target state or a set of overriding instructions; and updating the operational parameter of the electronic pump based on the second value.

14. The method of claim 7, wherein modifying the operational parameter further comprises:

determining whether an elapsed time exceeds a duration threshold associated with a wireless signal; and modifying, with the computer system, the operational parameter of the electronic pump based on a determination that the elapsed time exceeded the duration threshold associated with the wireless signal.

15. The method of claim 7, wherein the electronic pump is a first electronic pump, the method further comprising:

determining a summary value based on a set of measurements provided by the first sensor, wherein the summary value comprises a measure of central tendency; and sending the summary value via a wireless network to a second electronic pump.

16. The method of claim 15, wherein the value is a first value, and wherein determining the summary value further comprises:

obtaining a second value from a third electronic pump via the wireless network; and wherein determining the summary value comprises determining the summary value based on the second value and the set of measurements.

17. The method of claim 15, further comprising steps to determining the reference key.

18. The method of claim 7, further comprising steps to determining whether the fourth measurement satisfies a set of criteria.

19. An electronic pump comprising:

a housing;

a pipe within the housing;

a first sensor within the pipe;

a pump rotor to move fluid through the pipe;

a pump engine attached to the pump rotor to move the pump rotor; and a computing device comprising one or more processors and memory storing instructions that when executed by the processors cause the processors to effectuate operations:

obtaining a first measurement output by the sensor while the electronic pump operates at an operational parameter;

determining a first value based on the first measurement;

determining a reference key based on the first value and the operational parameter in a data structure stored in a local memory of the electronic pump;

obtaining a second measurement using a second sensor positioned separately from the first sensor;

determining a threshold based on the second measurement;

storing the threshold in the data structure in association with the reference key;

obtaining, with a computer system, a third measurement acquired by the first sensor and a fourth measurement acquired by the second sensor;

recomputing, with the computer system, the reference key based on the third measurement;

selecting, with the computer system, the threshold based on the reference key;

determining whether the fourth measurement satisfies a set of criteria based on the threshold; and modifying an operation of the electronic pump based on the fourth measurement satisfying the set of criteria.

20. The electronic pump of claim 19, wherein:

the first measurement is a pressure measurement;

the sensor comprises a multi-sensor device, the multi-sensor device comprising:

a low-pressure sensor, wherein the low-pressure sensor is capable of measuring pressures less than 100,000 kilopascals; and a barrier that shields the low-pressure sensor from a surrounding atmosphere; and the operations further comprise:

determining whether the pressure measurement is greater than a pressure threshold; and configure the barrier into a closed state to shield the low-pressure sensor from the surrounding atmosphere based on a determination that the pressure measurement is greater than the pressure threshold.

* * * * *